US010883304B2

(12) United States Patent
Monaghan

(10) Patent No.: US 10,883,304 B2
(45) Date of Patent: Jan. 5, 2021

(54) SLIDE OPENING DOOR ASSEMBLY

(71) Applicant: John Monaghan, Ossett (GB)

(72) Inventor: John Monaghan, Ossett (GB)

( * ) Notice: Subject to any disclaimer, the term of this patent is extended or adjusted under 35 U.S.C. 154(b) by 0 days.

(21) Appl. No.: 15/959,804

(22) Filed: Apr. 23, 2018

(65) Prior Publication Data

US 2018/0238101 A1 Aug. 23, 2018

Related U.S. Application Data

(63) Continuation-in-part of application No. PCT/GB2016/053292, filed on Oct. 21, 2016.

(51) Int. Cl.
*E06B 3/46* (2006.01)
*E05D 15/06* (2006.01)
(Continued)

(52) U.S. Cl.
CPC ..... *E06B 3/4654* (2013.01); *E05D 15/06* (2013.01); *E05D 15/0626* (2013.01); *E05D 15/0652* (2013.01); *E06B 1/52* (2013.01); *E06B 3/4636* (2013.01); *E06B 3/80* (2013.01); *E06B 5/00* (2013.01); *E06B 7/16* (2013.01);
(Continued)

(58) Field of Classification Search
CPC . E05D 15/0626; E05D 15/06; E05D 15/0652; E05D 15/063; E05Y 2600/528; E05Y 2201/11; E05Y 2800/424; E05Y 2900/14; E05Y 2600/52; E05Y 2600/56; E05Y 2600/41; E05Y 2600/60; E05Y 2900/132; E05Y 2201/688; E05Y 2201/684; E06B 7/16; E06B 5/00; E06B 3/80; E06B 3/4636; E06B 1/52
See application file for complete search history.

(56) References Cited

U.S. PATENT DOCUMENTS 2,889,585 A * 6/1959 Bon, III ..... E06B 7/22 49/425
3,400,490 A * 9/1968 Anderson ..... E05D 15/06 49/372
(Continued)

FOREIGN PATENT DOCUMENTS

EP 0417000 A1 3/1991
FR 2937365 A1 4/2010
(Continued)

*Primary Examiner* — Adriana Figueroa
(74) *Attorney, Agent, or Firm* — Shumaker, Loop & Kendrick, LLP; James D. Miller

(57) ABSTRACT

A pocket slide opening door assembly including a door leaf having a top edge, a door frame assembly, and a sliding assembly for slideable translation of the door leaf in relation to the door frame assembly between a closed position and an open position, wherein the assembly is provided in a plurality of parts for assembly in situ, including in a first part the door leaf, in a second part the door frame assembly with bay or pocket configured to receive the door leaf, or in second and third parts the door frame assembly and separate bay or pocket configured to receive the door leaf, and wherein the door assembly is disposed and configured in manner which prevents ligature about the door leaf top edge and in manner which prevents access to the sliding assembly for tamper purpose or for ligature purpose.

20 Claims, 17 Drawing Sheets

(51) Int. Cl.

| | |
|---|---|
| ***E06B 1/52*** | (2006.01) |
| ***E06B 3/80*** | (2006.01) |
| ***E06B 5/00*** | (2006.01) |
| ***E06B 7/16*** | (2006.01) |
| *E05F 15/60* | (2015.01) |
| *E04H 3/08* | (2006.01) |

(52) U.S. Cl.

CPC ..... *E04H 3/08* (2013.01); *E05D 15/063* (2013.01); *E05F 15/60* (2015.01); *E05Y 2201/11* (2013.01); *E05Y 2201/434* (2013.01); *E05Y 2201/684* (2013.01); *E05Y 2201/688* (2013.01); *E05Y 2600/41* (2013.01); *E05Y 2600/52* (2013.01); *E05Y 2600/528* (2013.01); *E05Y 2600/56* (2013.01); *E05Y 2600/60* (2013.01); *E05Y 2800/424* (2013.01); *E05Y 2900/132* (2013.01); *E05Y 2900/14* (2013.01)

(56) References Cited

U.S. PATENT DOCUMENTS 3,779,588 A * 12/1973 Raymon ..... E05B 65/0864 292/57
4,208,755 A * 6/1980 Shepherd ..... A47K 3/34 15/160
4,308,692 A * 1/1982 Rumble ..... E06B 1/52 403/231
4,325,204 A * 4/1982 Martine ..... E06B 3/4654 49/372
4,561,210 A * 12/1985 Kvas ..... E06B 3/4654 49/372
4,742,645 A * 5/1988 Johnston ..... E06B 3/4654 49/372
4,891,921 A * 1/1990 Governale ..... E05B 65/087 292/39
7,441,726 B2 * 10/2008 Melberg ..... B64C 1/1469 244/129.4
7,735,262 B2 * 6/2010 Peterson ..... E06B 3/4654 49/372
2006/0145007 A1 7/2006 Melberg
2006/0150545 A1 * 7/2006 Migliorini ..... E06B 3/4654 52/204.1
2006/0230684 A1 * 10/2006 Poole ..... E05D 15/0634 49/409
2006/0242908 A1 * 11/2006 McKinney ..... E05F 15/60 49/280
2010/0147042 A1 * 6/2010 Chen ..... E05C 17/60 70/99

FOREIGN PATENT DOCUMENTS

| | | | |
|---|---|---|---|
| FR | 2961245 | A1 | 12/2011 |
| IT | 1329977 | A | 3/2001 |
| WO | 9013725 | A1 | 11/1990 |

* cited by examiner $O^{O}(O^{T})=$ $O^{S}(O^{C},O^{P})=$ $O^{O,S}=$ $O^O(O^T)=$ $O^S(O^C,O^P)=$ $O^{O,S}=$

SLIDE OPENING DOOR ASSEMBLY

CROSS-REFERENCE TO RELATED PATENT APPLICATIONS

This is a continuation-in-part patent application of copending International Patent Application Ser. No. PCT/GB2016/053292, with an international filing date of Oct. 21, 2016, which claims priority to GB1518698.4 filed on Oct. 21, 2015, GB1608618.3 filed on May 16, 2016, GB1610672.6 filed on Jun. 20, 2016 and GB1617658.8, the disclosures of each which is incorporated herein by reference in its entirety.

FIELD

The present invention relates to a slide opening door assembly, a kit comprising a slide opening door frame assembly and a door leaf, a method for assembling a door leaf in a slide opening door frame assembly, and the use thereof in manner to prevent misuse including ligature and/or tampering, more particularly the use thereof in mental health or secure structures or institutions which house vulnerable or violent individuals.

BACKGROUND

In buildings which house vulnerable or violent individuals there is often a need to secure against accidents, intentional self-harming, damage to property or the like. One particular example of this is buildings which house individuals with mental health problems who are, in many cases, more liable to accidents and in some cases may be prone to harming themselves intentionally.

A risk exists that an individual might damage their surroundings and thereby create an insecure or unsafe environment or create and environment which presents an opportunity to self-harm. In such case it may be required to transit the individual to temporary accommodation. Transit and temporary housing both present further security risks.

A particular concern is to prevent an opportunity presenting itself for an individual to take their own life by hanging. A dual approach is taken to prevent such an opportunity presenting itself, firstly removing any material which might serve as a ligature, and secondly removing any point in a room which might serve as a ligature point.

Doors present a particular ligature risk. By definition a hinged opening door exposes a door hinge and door leaf top edge on opening. Although efforts have been directed at eliminating ligature points from doors, addressing in particular modifications to the door hinge, door top edge and architrave which might be used to secure a ligature, hinged opening doors by definition continue to present a ligature risk.

Vulnerable or violent individuals often possess tremendous strength. It is therefore a requirement that their environment is robust and constructed to withstand impact, herein referred as tampering. Walls, doors and the like are constructed to a high specification using reinforced or strengthened materials compared to those used in corresponding domestic environments.

There remains a need to overcome, obviate or mitigate one or more disadvantages of the prior art hinged doors, whether identified herein or elsewhere, or to provide for an alternative to or improvement of existing hinged door assemblies.

SUMMARY

There is provided herein an anti tamper and/or anti ligature pocket slide opening door assembly addressing this need, comprising a door leaf and door frame assembly which comprises a pocket at the side of the door frame assembly. By making use of an opening and closing mechanism other than a pivotal mechanism, i.e. other than a hinge mechanism, a sliding door assembly is provided which presents a top edge of the door leaf received within and enclosed by the frame assembly in closed position and in open position and in any position therebetween. In particular the door assembly prevents ligature by eliminating traditional hinged opening ligature points, notably the hinge and the exposed door leaf top edge at an open hinged opening door leaf.

It will be apparent to the skilled person that by "a top edge of the door leaf received within and enclosed by the frame assembly", reference herein is to said top edge being substantially coplanar with and within the confines of the frame assembly "in closed position and in open position and in any position therebetween". This is in contrast to the exposed door leaf top edge at an open hinged opening door leaf.

Moreover it will be apparent that the herein "top edge of the door leaf received within and enclosed by the frame assembly" maintains its disposition in relation to the frame assembly "in closed position and in open position and in any position therebetween". That is to say that the interface of top edge of door leaf and frame assembly is the same in all positions, and is effectively a "closed" interface, even in the case that the door leaf is open or partially open. This is in contrast to the exposed door leaf top edge at an open hinged opening door leaf.

Moreover it will be apparent that the herein "top edge of the door leaf received within and enclosed by the frame assembly" is not exposed, i.e. does not present a ligature point, with the door leaf in open or partially open position. Thereby the door assembly herein eliminates traditional hinged opening ligature points, notably the exposed door leaf top edge at an open hinged opening door leaf. More particularly, all of the hereinabove understanding of the referenced term is apparent in the common perception of disposition and function of pocket slide opening doors. It will be apparent moreover that in the case of other slide opening doors, such as folding slide opening doors, which lack a pocket and use a form of pivotal mechanism in some respects resembling a hinge opening door, the top edge of the door leaf is not received within and enclosed by the frame assembly "in closed position and in open position and in any position therebetween".

Sliding doors are vulnerable to impact, lacking a fixed point in relation to their frame. Sliding doors have therefore not been considered for use in housing vulnerable or violent individuals.

A sliding door assembly comprises a sliding assembly which provides a sliding point of engagement of door leaf in door frame assembly. Such sliding point of engagement potentially renders the door leaf vulnerable to tampering for example by impact at a face of the door leaf.

In embodiments the door assembly is configured in manner to provide overlap of door and frame at the door leaf top edge and at closing side edge and pocket side edge and thereby prevents tampering and/or reduces tamper risk.

Overlap may be overlap of one face of said door leaf and said frame assembly. This may be for example in the sense of overlap provided in the case of a closed hinged opening door assembly wherein said hinged opening door leaf is disposed to abut a door frame or part thereof such as a door jamb, in closed position only, at one face thereof.

Overlap may be overlap of two oppositely facing faces of said door leaf with two oppositely facing faces of said frame assembly, such as two outwardly facing faces of said door leaf and two inwardly facing faces of said frame assembly, or may be overlap of two inwardly facing faces of said door leaf, which may be internally disposed within said door leaf or disposed in manner to project from said door leaf, with two outwardly facing faces of said frame assembly or a combination of two or more thereof. This is in contrast to the sense of overlap provided in the case of a hinged opening door assembly, for which it would not be possible to provide overlap at two door leaf faces, since such would prevent functioning, i.e. opening, of said hinged opening door leaf.

Overlap of a face or faces of said door leaf herein may of a face or faces of said sliding assembly or part thereof comprised in said door leaf. Overlap of a face or faces of said frame assembly may be of a face or faces of said sliding assembly or part thereof comprise in said frame assembly.

In embodiments the door assembly herein is an anti ligature sliding pocket door assembly which comprises a concealed sliding mechanism, concealed door leaf top edge and concealed door leaf closing side edge.

More particularly the presently claimed sliding pocket door assembly addresses the hereinbefore defined needs. In embodiments the pocket slide opening door assembly herein comprises a door leaf which is secured within a pocket in open position, is concealed and secured within the pocket at a pocket edge of said door leaf in partially open position and in closed position and is additionally concealed and secured within a frame assembly at a closing edge of said door leaf in closed position. The door leaf is additionally concealed and secured within the frame assembly at a top edge and pocket side edge of said door leaf in open, partially open and closed position.

In embodiments the door leaf is additionally concealed and secured within the frame assembly at a bottom edge thereof in open, partially open and closed position.

In embodiments concealing of side edges and top edge is by means of overlap with the frame assembly in anti ligature and anti tamper manner, whereby the door assembly is also robust to tampering by sideways impact to the door leaf. In embodiments concealing of bottom edge is by means of overlap with the frame assembly in anti ligature and anti tamper manner, whereby the door assembly is also robust to tampering by sideways impact to the door leaf.

"Concealing . . . by means of overlap" is in the sense that said edge is not accessible for ligature or tamper. Moreover "concealing . . . by means of overlap" serves to interrupt any direct path or clear line of sight across an edge of said door leaf from one face of said door leaf to the other face thereof. Thereby the door leaf edge, in particular the top edge, is robust to ligature attempt.

Securing comprises enclosing the respective door leaf or door leaf edge with tight tolerance between the door leaf and the pocket or frame. For example the door leaf and the frame assembly have tolerance therebetween sufficient for said slideable translation of said door leaf in said frame assembly but insufficient for access therebetween for ligature purpose or for providing a direct path or clear line of sight between said door leaf and said pocket or frame. Moreover the door leaf and the frame assembly have tolerance therebetween sufficient for said slideable translation of said door leaf in said frame assembly but insufficient for non-slideable translation therebetween, such as in a direction perpendicular to the direction of said slideable translation. Thereby the door leaf or edge thereof, is robust both to ligature attempt and tampering attempt in particular by sideways impact to the door leaf.

In embodiments the sliding assembly for such sliding door assembly is concealed in anti ligature and anti tamper manner in all positions. For example any ligature points and/or tamper points comprised in said sliding assembly are concealed from view or are concealed from access or both, or said sliding assembly or part thereof which is visible or accessible or both, lacks ligature points or tamper points. Thereby the sliding assembly or its parts is in effect concealed for ligature and tamper purpose.

In embodiments the sliding point of engagement for such sliding door assembly is concealed in anti ligature and anti tamper manner in all positions, In embodiments there is therefore herein provided a pocket slide opening door assembly comprising: a door frame assembly which comprises a pocket and a door leaf wherein the door assembly comprises a sliding assembly for slideable translation of the door leaf in relation to the door frame assembly between a closed position and an open position wherein the door leaf comprises door leaf top edge; wherein the door frame assembly provides an overhead overlap ($O^O$) with the door leaf at the door leaf top edge, with the door leaf in closed position, for example provided by means of at least one overhead overlap element to the door frame assembly; and provides a side overlap $O^S$ with the door leaf at both side edges thereof with the door leaf in closed position, for example in the form of a closing overlap $O^C$ and a pocket overlap $O^P$ at respective closing side edge and pocket edge thereof; wherein the sliding assembly or its parts are disposed within the door frame assembly headpiece at a top portion of the top overlap or overhead the top (or overhead) overlap in manner which prevents access to the sliding assembly for tamper purpose or for ligature purpose or both.

In embodiments said sliding parts are independently disposed in manner which prevents access to the sliding assembly parts for tamper purpose or ligature purpose or both. In embodiments the sliding assembly or its parts are disposed within the headpiece of the frame assembly at a top portion of the top (or overhead) overlap and also at an intermediate portion of the top (or overhead) overlap or a lower portion of the top (or overhead) overlap, or both. In embodiments parts of the sliding assembly is coextensive with the top (or overhead) overlap, with the door leaf in a closed position. In embodiments the door frame assembly provides an overhead overlap ($O^O$) with the door leaf at the door leaf top edge, with the door leaf in closed position, and provides a pocket overlap ($O^P$) with the door leaf at the door leaf top edge or part of the top edge with the door leaf in open position and in part open position.

As hereinbefore defined, said pocket slide opening door assembly presents a top edge of the door leaf received within and enclosed by the frame assembly in closed position and in open position and in any position therebetween.

Reference herein is made to overhead overlap, $O^O$, top overlap and $O^T$, which are interchangeable and have the same meaning herein, Reference herein is made to overhead overlap element, top overlap element and overpanel, which are likewise interchangeable and have the same meaning herein, The sliding assembly or its parts is preferably disposed centrally above the door leaf. "Centrally" is preferably centred on door leaf mass.

In an embodiment the top overlap is adapted to be disposed out of physical reach, or out of physical reach at which any appreciable force can be delivered.

The oversized door leaf as herein defined may have height D.h in excess of 200 cm, such as up to 300 cm, or in a range of 204 cm to 300 cm, for example in excess of 208 cm, such as up to 300 cm.

In embodiments herein, preventing access to the sliding assembly is primarily by means of overhead overlap as hereinbefore defined, more particularly by overhead overlap provided about said sliding assembly or its parts having potential ligature or tamper points, said overhead overlap may nevertheless be separately or integrally coupled with said sliding assembly or its parts, wherein the door assembly may provide additional features as herein defined, such as constriction members and door leaf height, as contributory features in restricting access. For example this is in the case that sliding assembly or its parts present accessible ligature points or tamper points, for example a sliding assembly comprises an elongate profile member providing one or more overhead elongate tracks and configured to receive therein or therebetween one or more sliding elements associated with said door leaf or configured to receive thereabout one or more sliding elements associated with said door leaf and comprising one or more dynamic sliding surfaces, or suitably comprising one or more rolling sliding surfaces such as wheels.

In some embodiments, enhancing the contribution of contributory features may lessen the burden on the overhead overlap, which may accordingly be reduced in height, more particularly to that height required to prevent tampering or reduce tamper risk, specifically whereby the door assembly is robust to tampering by sideways impact to the door leaf. For example overhead overlap height o.h being the height of the door leaf overlapped by the overhead overlap element or being the vertical distance between a lower edge of the overhead overlap element and the top edge of the door leaf may be selected in the range from 1.2 cm or 2 cm up to 3 cm, 5 cm, 5.5 cm or 8 cm as hereinbelow defined, up to 15 cm or 20 cm.

In one embodiment therefore, by selection of greater door leaf height it may be possible to operate with lesser overlap. The door leaf may for example have height D.h in the range from 230 cm to 290 cm and overhead overlap height in the range selected from 1.2 cm to 8 cm, 2 cm to 8 cm and 5 cm to 8 cm or other range as hereinbelow defined. Thereby overhead overlap is disposed at elevation above the floor (clear opening height) of 222 cm to 288 cm, such as 222 cm to 285 cm. By this means overhead overlap may be rendered inaccessible to flexible or deformable ligatures in the lower end of the clear opening height range. Preferably door leaf height is in the range 240 cm to 290 cm and overhead overlap height o.h in the range selected from 1.2 cm to 8 cm, 2 cm to 8 cm and 5 cm to 8 cm or other range as hereinbelow defined. Thereby clear opening height is in the range 232 cm to 288 cm, such as 232 cm to 285 cm. By this means overhead overlap may be rendered inaccessible to rigid or resiliently deformable ligatures.

Selection of greater door leaf height also permits selection of greater overlap height without compromising clear opening height. In a further embodiment the door assembly may comprise door leaf height in the range 240 cm to 290 cm, more preferably 260 cm to 290 cm, and provide overhead overlap height o.h. in the range 40 cm to 60 cm.

Alternatively or additionally, by selection of one or more constriction members, preferably as hereinbelow defined, it may be possible to operate with lesser overlap. The door assembly may for example provide constriction member(s) within the overhead overlap as hereinbefore defined, in combination with overhead overlap height o.h in the range selected from 1.2 cm to 8 cm, 2 cm to 8 cm and 5 cm to 8 cm. Overhead overlap may thereby be rendered inaccessible to flexible or deformable ligatures. Moreover, and depending on the nature of constriction member(s) selected, the overhead overlap may be rendered inaccessible to rigid or resiliently deformable ligatures.

In further embodiments herein, said sliding assembly or its parts, comprises no accessible ligature points or tamper points, as hereinbefore defined, for example, point of engagement of door leaf and frame assembly is internal to a sliding assembly herein and is integrally coupled therewith, enclosing door leaf top edge and lacking downwardly inverted or convex or horizontal or accessible low tolerance opposed camming surfaces which might offer potential ligature points. The overhead overlap may accordingly be selected in reduced height, more particularly to that height required to prevent tampering or reduce tamper risk, specifically whereby the door assembly is robust to tampering by sideways impact to the door leaf. In said embodiments, said overhead overlap prevents access to at least that part of said sliding assembly associated with said door leaf and more particularly prevents access to the door leaf top edge and the sliding point of engagement.

For example overhead overlap height o.h being the height of the door leaf overlapped by the overhead overlap element or being the vertical distance between a lower edge of the overhead overlap element and the top edge of the door leaf may be selected in the range as herein defined for side overlaps from 1.2 cm or 2 cm up to 3 cm, 5 cm, 5.5 cm or 8 cm as hereinbelow defined or conceivably in the range up to 15 cm or 20 cm.

In embodiments herein overhead overlap of door leaf top edge with door leaf in closed position comprises or is provided by the sliding assembly or one or more of its parts, more particularly a part configured to be disposed in the door assembly clear opening. In embodiments herein door leaf top edge or that portion thereof overlapped by said frame assembly with door leaf in closed position, for example configured to occupy the clear opening in closed and part closed position, at least in part comprises or is provided by a top edge of one or more parts of a sliding element associated therewith and preferably coextensive therewith.

For example, this is in the case that sliding assembly or its parts lack accessible ligature points or tamper points. In embodiments herein a sliding assembly comprises an elongate profile member providing one or more overhead elongate tracks and configured to receive thereabout an elongate sliding element comprising one or more static sliding surfaces, and substantially coextensive with and/or continuous with the door leaf top edge or that portion thereof configured to occupy the clear opening in closed and part closed position. Thereby said sliding element presents a continuous elongate top edge of said door leaf and eliminates a potential ligature point which might be presented at said door leaf top edge between two spaced apart sliding elements.

A particular instance of tampering which is of concern in mental health care institutions and secure institutions or environments in general is the attempt by an individual to prevent functioning of a door assembly, particularly to obstruct a door leaf or door assembly, and in particular obstruct the door leaf or door assembly in closed position, also known as barricade. Barricade includes the application by an individual of closing force to a door leaf from one side thereof, herein the inside face, thereby preventing entry or exit thereby from an outside face. Of particular concern is tampering by obstruction or barricade with door leaf in closed position. An individual may choose to barricade a door for one of any number of reasons however in all cases it is imperative that access is gained as soon as possible, in case of potential risk to life.

It is therefore desirable that door sets offer minimal features which might offer a point against which a barricading force may be applied, and current design of door handles, windows, locks architraves etc. takes barricade risk into consideration. For example our hinged opening door sets allow normally inward opening doors to be released in order to open outwards in an emergency.

We have therefore perceived a need for and provide herein an anti tamper pocket slide opening door assembly comprising a barricade solution enabling emergency access from outside. However the herein slide opening door assembly differs from the hinged opening counterpart in that the slide opening door assembly is constrained by the overhead sliding assembly from being released to open outwards in an emergency. Moreover by the nature of obstruction by barricade, it must be assumed that the door leaf might be obstructed from sliding into the pocket. For example, the manner of closing force applied may be such as to prevent override and slide opening of the door leaf.

In a preferred embodiment therefore, we provide herein an anti tamper pocket slide opening door assembly which provides for door override and door leaf removal from an outside face or clear opening face thereof, with the door leaf in closed or substantially closed position, in case of tampering by door leaf obstruction, more particularly by barricade.

Door leaf removal may be achieved in a number of ways. Overhead and/or side overlap (s) may be disposed at the inside face of the door assembly herein, being the face that is to be disposed in manner that it is vulnerable to ligature attempt, whereby said overlap (s) would not hinder door leaf. However overhead overlap and/or side overlap (s) provided at the outside face of the door assembly herein, whereby the assembly is robust to tampering by sideways impact to the door leaf at an inside face thereof, present a hindrance to door leaf removal.

Therefore the herein slide opening door assembly differs again from the hinged opening counterpart in that the means for opening and closing thereof cannot be directly accessed and overridden, whereby, should the herein slide opening door be disengaged from the door frame assembly at the sliding assembly, the door leaf would nevertheless remain constrained from opening outwards by the herein defined overlaps and overlap element(s).

The herein defined slide opening door assembly is thus counter-intuitive in the sense that door removal with door leaf in closed position, is hindered more from the outside face of the door assembly than from the inside face at which the door leaf is considered most vulnerable. Moreover any teaching from prior art hinged opening door assemblies serves only to teach away from a solution to this problem.

We have now however found that the slide opening door assembly herein may benefit from the provision of a sliding mechanism for translation of the door leaf between closed position and open position, in a respect which would not be deducible or suggested by a knowledge of the counterpart hinge opening door. In particular known hinge opening door assemblies neither contemplate nor suggest the removal of side or overhead door jambs in order to gain access.

More specifically the slide opening door herein comprising an overhead overlap to prevent access for tamper or ligature at the sliding assembly provides for door leaf override or removal or both, and thereby addresses tamper risk at sliding assembly intended to prevent functioning of or to obstruct the door assembly. More particularly the assembly herein comprises removable overhead overlap at the outside face or clear opening face thereof, provides thereby facilitating door override and/or removal and/or direct access to the sliding assembly providing engagement of door leaf top edge and door frame assembly, and thereby to the primary point for door leaf removal.

Hinged opening doors provide no precedent firstly for the effectiveness of the herein defined overhead overlap element in overcoming the inherent vulnerability of a sliding door assembly to tamper and ligature, and there is furthermore no precedent for the provision of a removeably mounted overhead overlap which would be sufficiently robust to overcome the inherent weaknesses of a sliding door assembly and also would be sufficiently readily accessed for secure removal to overcome the inherent obstacle encountered with a slide opening door to outward door leaf opening/removal.

In a particular embodiment therefore, our pocket slide opening door assembly is a door assembly comprising: a door frame assembly which comprises a pocket and a door leaf wherein the door assembly comprises a sliding assembly for slideable translation of the door leaf in relation to the door frame assembly between a closed position and an open position wherein the door leaf comprises door leaf top edge; wherein the door frame assembly provides an overhead overlap ($O^O$) with the door leaf at the door leaf top edge, with the door leaf in closed position, suitably provided by means of at least one overhead overlap element to the door frame assembly; and provides a side overlap $O^S$ with the door leaf at both side edges thereof with the door leaf in closed position; wherein the sliding assembly or its parts are disposed within a headpiece to the door frame assembly at a top portion of the overhead overlap or overhead or otherwise in relation to the overhead overlap in manner which prevents access to the sliding assembly for tamper purpose or ligature purpose or both; and wherein said door assembly addresses tamper risk at the sliding assembly in closed position, by attempt to preventing functioning of or obstructing said door assembly or part thereof.

In embodiments the door assembly provides for door leaf override and door leaf removal, with the door leaf in closed or substantially closed position, by means of removable overhead overlap element.

In embodiments herein said overhead overlap and side overlaps are provided at a clear opening or outside face of said door assembly whereby the door assembly is robust to tampering by sideways impact to the door leaf at the inside face thereof, being that face which is to be disposed in manner that it is vulnerable to tampering.

In embodiments the outside face of said door assembly herein comprises a clear opening face of said frame assembly.

The sliding assembly or its parts disposed in the headpiece, is suitably disposed in relation to or associated with the headpiece. The sliding assembly or its parts disposed at a top portion of the overhead overlap is suitably disposed at the top portion of the overhead overlap and may also be disposed at an intermediate portion and optionally also a lower portion of the overhead overlap. In embodiments the sliding assembly or its parts provides the overhead overlap, and is therefore coextensive therewith.

In embodiments said overhead overlap element is removeably mounted or mountable to the clear opening face of said frame permitting access for door override, more particularly door override and door leaf removal.

In embodiments herein door frame assembly overhead overlap of door leaf top edge with door leaf in closed position comprises or is provided by the sliding assembly or one or more of its parts wherein said sliding assembly comprises one or more elongate track elements and wherein one or more track elements are removable, more particularly that part thereof corresponding to the clear opening.

Preferably door leaf top edge is profiled in anti tamper manner at the inside face thereof and/or overlap element provided at the inside face of a door frame assembly headpiece is profiled or may be upwardly tapered.

In embodiments said overhead overlaps and/or said side overlaps at either or both door leaf side edges are independently provided to both faces of said frame assembly.

Substantially closed position is closed to an extent insufficient to permit either barricade removal or entry via open aperture remaining in clear opening or insertion of barricade removing means.

As herein defined a 'clear opening face' herein is that face or faces of the herein door assembly defined by said frame assembly including overlaps as herein defined, and may be the dominant access or entry face. In embodiments, overlaps are provided at an outside face of the door leaf herein, whereby said door leaf is robust to tampering by sideways impact to the door leaf. In embodiments therefore a clear opening face of a frame assembly herein is an outside face thereof. An inside face of said door frame assembly comprising overhead and side overlaps for anti ligature purpose may likewise be termed a clear opening face, and for the present purposes the relative sizes of overlaps at inside and outside faces is not considered of significance in assigning a dominant clear opening face.

In a preferred embodiment in a pocket slide opening door assembly herein the at least one overhead overlap element is provided separately and secured in position in relation to the door frame assembly after loading the door leaf in the door frame assembly. Preferably securing is by means of anti tamper and anti ligature fixing means, more preferably by removable anti tamper and anti ligature fixing means. Suitably therefore said overlap comprises anti tamper and anti ligature means to receive anti tamper and anti ligature fixing means. An optional overhead overlap element provided to the inside face of the door assembly is conveniently fixed, or may be secured by permanent or semi-permanent means to the frame assembly, in particular in manner that there can be no potential risk of tamper or ligature.

In embodiments flanges and slots are provided on adjoining faces of the frame assembly and overhead overlap element which are vertically disposed in use, and sliding insertion is upwardly directed, from within the clear opening. Corresponding sliding removal is downwardly directed, into the clear opening. Alternative or additional configurations permitting insertion and removal, sliding or otherwise, may be envisaged.

Removeable fixing means for mounting of overhead overlap element as hereinbefore defined affords access to the sliding assembly or part thereof. Preferably removeable mounting is by recessed attachment fixing as herein defined which fixing is thereby anti ligature and rendered non-removeable for anti tamper purpose, and is accessed by secure overlap element removal means such as by key or anti tamper tool means as known in the art or described herein. Secure overlap element removal may alternatively comprise electronic activation means, which may be locally or remotely operated for activation of an internally disposed removeable mounting attachment fixing. Such sliding assembly suitably comprises a manual or automated door override which activates door opening.

The pocket slide opening door assembly herein as hereinbefore defined nevertheless poses a further problem in terms of the convenience for installation and cost efficiency for manufacture, which distinguishes it yet further from a counterpart hinged opening door. That is to say the door assembly is handed, comprising different configuration of overlap, or manner of fixing thereof, at the clear opening or outside face of the door assembly and the inside face thereof. This requires a purchaser to specify whether the pocket is to be disposed to the left hand side or the right hand side of the clear opening, at a given face, which information may not be apparent at the time of purchase. Moreover this introduces higher manufacturing costs, in the need to manufacture distinct left handed and right handed versions.

We therefore provide in further embodiments a non-handed pocket slide opening door assembly providing handed overhead overlap configuration at respective door leaf faces selected from different overhead overlap configuration at respective faces and overhead overlap at one face only with overhead overlap absent at the other face, wherein at least one overlap is provided by an overhead overlap element removably mountable to the clear opening face of said door assembly as hereinbefore defined by means of anti tamper and anti ligature fixing means, and optionally a further overhead overlap is semi-permanently mountable to the other face thereof by means of semi-permanent anti tamper and anti ligature fixing means, wherein said non-handed frame assembly is disposable with pocket to either side of clear opening, wherein said assembly comprises a selection of same and different overhead overlap elements for securing at each face, by a selection of same and different fixing means. Said at least one removably mountable overhead overlap element provides for access for door override or door removal or both.

The non-handed assembly herein overcomes both problems encountered by purchaser and manufacturer, enabling the manufacture and purchase of a single assembly variant which may be installed in any required handed configuration. The non-handed assembly herein may further be provided with a selection of overhead overlap elements and optionally with one or more side overlap elements addressing specific ligature risk and tamper risk considerations.

In particular the frame assembly may provide an overhead overlap element to each face of said door leaf, one thereof being secured in antitamper manner, and the other thereof being secured for external maintenance and door override access. Preferably the frame assembly is non-handed, comprising two overhead overlap elements for securing each to a face of the frame assembly, by securing fixings which are at one face non-removable for antitamper purpose, and at the other removable, for purpose of door override overhead overlap element and door removal in door lock close position.

In embodiments as herein, said overhead overlap element comprises said sliding assembly or one or more of its parts and is removably mounted to said frame assembly as hereinbefore defined in manner that removal of said overhead overlap element comprises removal of said sliding assembly or its one or more parts and thereby door leaf removal as hereinbefore defined. Said door leaf may be removably mountable together with said removably mountable overhead overlap element. Door leaf is suitably removably mountable by means of integral coupling engagement with one or more sliding elements, said elements being slidingly engaged or slidingly engageable with said removable sliding track or with track portion of removable overhead overlap element.

Preferably an overhead overlap element comprises a part of said sliding assembly which is configured to be disposed in relation to that part of the frame assembly corresponding to the clear opening, i.e. not including that part which is to be disposed in the pocket.

More particularly an overhead overlap element as hereinbefore defined comprises a sliding track element for a sliding assembly herein, for coupling or mounting to the door frame assembly at a headpiece thereof, and sliding engagement with one or more sliding elements provided by said door leaf at the top edge thereof or for coupling or mounting to the door leaf herein.

In embodiments the overhead overlap element may comprise overlap portion which is same as or different to sliding track portion, for example overlap portion may be disposed outwardly of or may comprise one or more sliding track portions configured to receive thereabout or therebetween or to be received by one or more sliding elements, or may be configured adjacent thereto. Preferably said one or more sliding elements are static sliding elements and said door frame assembly comprises a door frame assembly bottom piece disposable across the door frame assembly and slideably engageable with the door leaf lower edge by dynamic sliding means such as rolling sliding means.

In embodiments herein, the overlap portion comprises a sliding track comprising a flange or beam configured to be received in a mating open sided or closed sided channel of one or more sliding elements, for example a flange having regular or irregular cross section selected from rectangular, trapezoid, radiused or part radiused (at one face, such as an upwardly disposable face), oblong, ovoid and circular and combinations thereof, including combinations of same shapes having different radii or relative dimensions.

In alternative embodiments the overlap portion comprises one or more sidewalls of a track configured to receive one or more sliding elements having regular or irregular cross section selected from rectangular, trapezoid, radiused or part radiused, oblong, ovoid and circular and combinations thereof, including combinations of same shapes having different radii or relative dimensions. Preferably such flange or track is not accessible for ligature or tamper, more particularly offers no ligaturable horizontal or inclined or concave surface.

In alternative embodiments an overhead overlap is disposable outwardly of either or both faces of said door leaf and provides at the overlap face thereof a sliding track being slidingly engageable with a sliding element comprising the overhead overlap portion of said door leaf, or part thereof, wherein said sliding track and sliding element comprise a static sliding surface at respective overlapping faces of said overhead overlap element and door leaf, for example a low friction coating thereof.

A door assembly herein further comprises side overlap $O^S$ of said door leaf at both side edges thereof with said door leaf in closed position. Opening side overlap or pocket side overlap is independently disposed at one or both faces of said door leaf. Closing side overlap may be at one face of said door leaf, suitably at a clear opening face whereby in said door assembly as hereinbefore defined, said door leaf is restrained at said closing side edge thereof, from removal to said clear opening face, and optionally additionally at both faces The door assembly herein comprising door override and door removal by removable overhead overlap element, as hereinbefore defined, suitably provides for release of said door leaf from side overlap (s) by any of a number of means including but not limited to those disclosed herein.

For example in said assembly providing for removal of overlap element as hereinbefore defined, closing side overlap is at both faces of said door leaf and tolerance and/or overlap is such that said door leaf is not restrained at said closing side edge or pocket side edge or both, from removal to said clear opening face.

Alternatively or additionally, in said assembly providing for removal of overlap element as hereinbefore defined, said door leaf is restrained at both side edges from removal to said clear opening face.

The door assembly herein may comprise a sidepiece or part thereof removeable to said clear opening face, by anti tamper and anti ligature means in similar manner to removal of overhead overlap element as hereinbefore defined.

More particularly said door assembly provides for release of door leaf from one or more side overlaps to the clear opening face, by means of release from one or more side overlap elements to the clear opening face of a sidepiece or pocket to the door frame assembly, said side overlap element(s) being removable or being deformable about the door leaf side edge(s), and/or by means of one or more deformable side overlap portions of the door leaf, said portions being deformable about said side overlap (s) or side overlap element(s).

In embodiments herein, either or both of said side edges of said door leaf and/or either or both of said side pieces to said door frame assembly is deformable about or within the other thereof, permitting removal of said door leaf by deformation. Deformation is suitably activated by force withdrawing said door leaf to said clear opening face, which may be the weight of the door leaf caused to tilt out of vertical alignment, enclosed in said frame assembly.

Deformation is suitably of at least the overlap portion of one of said door leaf side edges or of part of the overlap portion of each of a door leaf side edge and an overlapping frame assembly side piece. Door leaf may comprise deformation portions at one of both side edges thereof coextensive with side edge. Deformation may be asymmetric, such that said side piece is configured to deform outwardly to said clear opening face and/or said door leaf side edge is configured to deform inwardly away from said clear opening face and towards a barricade face. Deformation may be resilient deformation, such that said deformation occurs only in response to said door removing force, whereby the door leaf is secured in said frame assembly against tampering, for example against an impact at the barricade face thereof being less than the weight of the door leaf itself.

Resiliently deformable materials are known in the art, and are selected for example from high duty natural and synthetic rubbers, compressible elastic materials and the like, and combinations thereof including combinations of same materials in different configurations or properties.

Deformable configurations may be envisaged by those skilled in the art, and for example comprise one or more pivoting door leaf portions and/or one or more pivoting sidepiece portions. Suitably pivot is by rotating ball or cylinder in socket style joint or by flexible hinge or low density folding portion.

In a further broadest embodiment, we provide herein a pocket slide opening door assembly comprising: a door frame assembly which comprises a pocket and a door leaf wherein the door assembly comprises a sliding assembly for slideable translation of the door leaf in relation to the door frame assembly between a closed position and an open position wherein the door leaf comprises door leaf top edge; wherein the door frame assembly provides an overhead overlap ($O^O$) with the door leaf at the door leaf top edge, with the door leaf in closed position; and provides a side overlap ($O^S$) with the door leaf at both side edges thereof with the door leaf in closed position; wherein the sliding assembly and its parts are disposed within a headpiece to the door frame assembly at a top portion of the overhead overlap or in relation to said overhead overlap, which prevents access to the sliding assembly for tamper purpose and for ligature purpose; wherein at least one door leaf side edge is deformable about said side overlap, more particularly said door leaf comprises one or more deformable side overlap door leaf portions, said portions being deformable about said side overlap (s) thereby providing for door leaf override and door leaf removal, with the door leaf in closed or substantially closed position whereby said door assembly addresses tamper risk at the sliding assembly in closed position by attempt to preventing functioning of or obstructing said door assembly or part thereof. The deformable portion of the door leaf is suitably coextensive with the side overlap portion(s) of the frame assembly.

Alternatively or additionally either or both side overlaps may be removably mounted or may be deformable about said door leaf side edge, for example comprising one or more side overlap elements to the clear opening face of a sidepiece or pocket to the door frame assembly, said side overlap element(s) being removable or being deformable about the door leaf side edge(s) thereby permitting door leaf override and door leaf removal, with the door leaf in closed or substantially closed position. The removable or deformable side overlap of the frame assembly or side overlap element(s) is suitably coextensive with the deformable portion(s) of the door leaf.

The overhead overlap may be provided by means of at least one removably mounted overhead overlap element to the door frame assembly as hereinbefore defined. By means of removal of the overhead overlap element the door leaf may be removed by release from one or more side overlaps to the clear opening face, more particularly by means of release from one or more side overlap elements to the clear opening face of a sidepiece or pocket to the door frame assembly, said side overlap element(s) being removable or being deformable about the door leaf side edge(s), and/or by means of one or more deformable side overlap portions of the door leaf, said portions being deformable about said side overlap (s) or side overlap element(s). The door assembly comprising deformable door leaf may benefit from any features of a door assembly as herein described.

Said door assembly comprising door leaf having deformable overlap portion as herein defined is unique to the presently envisaged pocket slide opening configuration, specifically such door leaf would not be compatible with a hinge opening counterpart, said door leaf lacking the necessary support to retain its planar profile in the absence of an overhead overlap and bottom overlap, with door leaf in part open position.

The door assembly herein comprising door override and door leaf removal by removable overhead overlap element, as hereinbefore defined, suitably provides for release of said door leaf from bottom overlap by any of a number of means including but not limited to those disclosed herein.

Suitably bottom overlap comprises a bottom piece to the frame assembly and includes a recessed or raised profile or combination thereof, for example a routered channel or flange of a floor track bridging the clear opening. The bottom piece or track may be profiled to either or both side thereof to prevent trip hazard.

Sliding door assemblies are known in a number of configurations including in front of the wall sliding door assemblies, in the recess sliding door assemblies and in the wall door assemblies also known as pocket door assemblies. The door assembly as herein defined is an in the wall assembly also known as a pocket door assembly. Sliding door assemblies may comprise a single door leaf or plural door leaves, for example two door leaves.

A 'pocket door' assembly herein is defined as an assembly comprising a door leaf and a hollow wall, pocket, recess, bay or compartment in a support such as the wall at the side of a doorway, or in the present context at the side of a door frame assembly. The door leaf may be slid into and concealed within the pocket in open position. A pocket may be provided by the door frame assembly or a support therefor or both. The hereindefined door frame assembly comprises a pocket.

The primary problem with such sliding pocket door assembly is providing for a secure closure of the door leaf. Accordingly the present pocket sliding door assembly provides a closing pocket to receive and enclose the door leaf closing side edge. The thus enclosed side edge is thereby capable of withstanding impact. The closing side pocket is preferably dimensioned to provide anti ligature tolerance about one or both faces of door leaf about the closing side edge. The closed door leaf is thus sealed against tampering and against the possibility of insertion of any ligature between door leaf and closing pocket.

An additional problem with such sliding pocket door assembly is restricting access to the sliding assembly. Accordingly the present pocket sliding door assembly provides, by means of the hereinbefore defined overhead overlap elements provided to each face of the door leaf, an overhead sliding pocket in which the sliding assembly is recessed. The sliding pocket is preferably dimensioned to provide anti ligature tolerance about one or both faces of door leaf about the top edge thereof. The thus recessed sliding assembly is thus sealed against tampering. The door leaf is moreover sealed against tampering and against the possibility of insertion of any ligature between door leaf and sliding pocket. Preferably the sliding pocket and door leaf are oversized, the door leaf thus extends within the sliding pocket to a sufficient depth to withstand impact exerted at a face of the door leaf with the door leaf in partially open position.

Our pocket sliding door assembly must provide high strength against impact for which it is required to be constructed from robust materials, rendering it heavy such that delivery, storage and handling as a single preassembled unit are impractical, dangerous and/or impossible and/or costly. Moreover our door leaf is oversized, which further contributes to the bulk and weight of the assembly and further compounds delivery and handling. Moreover one or more components of our frame assembly may be oversized, notably overhead components, providing the hereinbefore defined overhead overlap, sliding pocket, for the purpose of concealing and supporting the door leaf top edge, further compounding delivery, storage and handling and rendering these impractical and costly.

These problems are overcome by providing the door leaf as a separate component for retroloading during assembly. This in turn creates problems, since the door leaf cannot simply be loaded within the assembled frame assembly. To be enclosed at the top edge and side edges thereof with tolerance as hereinbefore defined the door leaf width and width are too great to be able to insert within the frame assembly. The hereinbefore defined pocket or opening pocket, closing pocket or closing overlap, and sliding pocket or overhead overlap, define a clear opening therebetween having clear opening width CO.w and clear opening height CO.h where CO.w is less than the width of the door leaf L.w and CO.h is less than the height of the door leaf L.h.

Alternatively therefore the door leaf might be mounted in the frame by assembling the frame around the door leaf, however this is labour intensive and thus costly, and presents complications with ensuring that no ligature points are presented by the assembled door assembly.

In one embodiment our invention provides a pocket slide opening door assembly as hereinbefore defined comprising a door leaf preloading cavity lining element and having separate closing side jamb of smaller internal depth and width than the preloading cavity lining element, for receiving the door leaf closing edge in the preloading cavity while loading the door leaf, subsequently reversing the door leaf into the pocket and fitting the closing side jamb to close off excess preloading cavity volume. The closing side jamb serves to generate tolerances of the order of less than 1 cm such as 0.1 to 0.6 cm between the jamb and door leaf. The preloading cavity lining element facilitates like tolerances between the pocket and door leaf in closed position. Specifically the closing side jamb closes off excess tolerance at the closing side edge. The preloading cavity lining element enables the door leaf to be aligned before reversing into the pocket, whereby there is no need for excess alignment tolerance. The closing side jamb is fitted by means of antiligature fixings. The frame assembly sidepiece profile, incorporating preloading cavity lining element and closing side jamb is continuous and presents no ligature points.

Preferably the door frame assembly comprises a head piece and two side pieces. Overlap $O^O$ is defined as a portion or portions of the door leaf overlapped by one or more overhead overlap elements. An overhead overlap element is provided separate from the head piece. Overlap $O^C$ is defined as a portion or portions of the door leaf overlapped by a closing side jamb. A closing side jamb is provided as a separate component of a sidepiece.

The door assembly of the invention thus comprises at least one oversized overhead overlap member for securing to a headpiece at respective adjoining faces, for example by means of a fixing element bridging said faces, located by means of a presunk fixing hole provided internally within the overhead overlap element and directed toward the headpiece-adjoining face thereof and/or the sidepiece adjoining faces thereof, accessed by a guide hole passing between an external face of the overhead overlap element and the presunk fixing hole.

It is within the scope of the invention to provide alternative means for loading the door leaf in the assembled frame.

Accordingly in a preferred embodiment a pocket slide opening door assembly herein comprises a deformable overlap, comprised at one or both door leaf side edges and/or at one or both of frame assembly closing side piece and pocket side piece part thereof, and removably mountable overhead overlap element as hereinbefore defined. Said assembly permits engagement of said door leaf, with said frame assembly at a bottom edge of said door leaf, with subsequent engagement of said door leaf at said side edges thereof with said frame assembly side pieces by deformation action, and subsequent engagement of said door leaf at top edge thereof with said frame assembly headpiece. Engagement with said headpiece may include engagement with sliding assembly. Alternatively said door leaf may comprise sliding assembly or part thereof separately or integrally coupled therewith, whereby engagement may be of sliding assembly parts, or sliding assembly with headpiece, by manually initiated engagement or by simple contact initiated engagement, for example in the case of cooperating mating sliding parts.

Said embodiment may include means for engaging said door leaf by elevation at the bottom edge thereof, or may comprise dual action mechanism for locking into frame assembly in closed position as hereinbefore defined.

Advantageously the overhead overlap is disposed in manner together with the door frame assembly or headpiece portion or component thereof to enclose the door leaf top edge. Overlap may be at one, preferably inside, or preferably both faces of the door leaf. Preferably overlap $O^O$ is at both faces of the door leaf and in combination with the door frame assembly or headpiece portion or component thereof receives, obscures, and encloses the door leaf top edge.

Advantageously a closing overlap and a pocket overlap are disposed in manner together with the door frame assembly or sidepiece or component thereof to enclose the door leaf closing side edge and pocket side edge. Overlap may be at one or preferably both faces of the door leaf. Preferably overlap $O^C$ and $O^P$ are independently at both faces of the door leaf and in combination with the door frame assembly or sidepiece or component thereof receive, obscure, and enclose the door leaf closing side edge and pocket side edge in closed position.

Advantageously the overlaps are configured in anti tamper manner in manner to withstand manual impact or manually inflicted impact.

A 'door leaf' as herein referred is as known in the art, and variously defined as a single independently moving panel of a door. A single door leaf features a single panel that fills an entire door way space. Usually referred to in common usage simply as the door itself. A door leaf as herein referred comprises two faces, being an inside face and an outside face, or being two inside faces, for example in case of an en-suite. An inside face is to be disposed in manner that it is vulnerable to ligature attempt, tampering, barricade attempt or the like. An outside face may be disposed in manner that it is vulnerable to ligature attempt, tampering, barricade attempt or otherwise. The door leaf top edge may be profiled in anti ligature manner.

A 'clear opening' as herein referred is the opening defined by a frame assembly herein, configured between a headpiece and side piece(s)/pocket and an optional bottom piece, including overlaps as herein defined.

A 'clear opening face' herein is that face or faces of the herein door assembly defined by said frame assembly including overlaps as herein defined. In embodiments, overlaps are provided at an outside face of the door leaf herein, whereby said door leaf is robust to tampering by sideways impact to the door leaf. In embodiments therefore a clear opening face of a frame assembly herein is an outside face thereof.

A 'door assembly' as herein referred may be a domestic or commercial slide opening door assembly, an interior or exterior slide opening door assembly or the like. Commercial slide opening door assemblies and exterior slide opening door assemblies may include high security hydraulically operated assemblies and the like. Preferably a door assembly as herein referred is a domestic slide opening door assembly, more preferably an interior domestic slide opening door assembly. By this is meant that the door assembly whilst being highly secure does not give a visual appearance of a high security door assembly.

A 'ligature' is anything used for tying or binding something tightly, for example a cord or wire. A ligature is therefore anything which might be used to form a noose for the purpose of strangulation, or to tie off a limb or appendage with the risk of causing harm, by intention or accident.

A 'ligature point' is defined as any point which is load bearing, for example able to support over 40 kg, that can be used to support a cord, rope or other material for the purpose of strangulation or causing harm.

In the present context, a ligature point is taken to refer to a 'ligature point' as known in the art of hinged opening doors and equally applicable in the present context, including and selected from any of assembly elements including door leaf top edge, gaps and apertures around door leaf top and side edges such as door leaf to frame assembly tolerances, fixing heads such as screw heads and the like; door leaf or frame assembly profiles including architraves, panelling and the like; door or frame furniture including door handles, locks and the like.

Additionally in the present context, a ligature point is taken to refer to previously unattributed 'ligature points' such as any of the above in the context of the art of sliding door assemblies in particular including and selected from any of sliding door leaf to sliding door frame assembly tolerances and also including sliding assembly profile, gaps and apertures providing access to sliding assembly, and the like. Sliding door assemblies are previously unknown in the context of housing individuals at risk of self harming.

Features of the door assembly disclosed herein prevent or reduce the risk of ligature associated with hinge opening door assemblies.

'Anti ligature' is defined as meaning opposed to or against ligature. Hence an anti ligature door assembly is such assembly which is opposed to or against ligature or which lacks ligature points.

'Anti ligature' features include any of the above 'ligature points' adapted to oppose ligature, for example chamfered or profiled door leaf top edge.

Reference herein to 'tamper' or 'tampering' is taken to mean to interfere with or interfering with, preferably to mean misuse of, misusing or attempt or attempting to prevent functioning of, for example including damage or damaging by dismantling or obstructing or by direct or indirect impact and the like. Reference is typically in relation to a door assembly or part thereof as herein defined, in any manner to interfere with said door assembly or part thereof as herein defined.

Features of the door assembly disclosed herein prevent or reduce the risk of tampering associated with hinge opening door assemblies.

Accordingly in the present context 'anti tamper' is defined as meaning opposed to or against tampering.

'Anti tamper' features include and are selected from any of any of the above features defined for the purpose of anti ligature, and additionally features for withstanding impact at any part of a slide opening door assembly and the like and preventing damage to the door assembly or part thereof or preventing malfunctioning of the door assembly or part thereof, in either case in particular to prevent generation of a ligature point or other self harming point. Anti tamper features include including and are selected from impact resistance features such as reinforcing by means for example of oversized frame elements, door leaf to frame overlap and the like.

Preferably the door frame assembly comprises anti ligature points as hereinbefore defined. Preferably the door frame assembly provides one or more upwardly tapered or embedded element(s) disposed at a door frame assembly headpiece, for example an architrave element as known in the art having a chamfered upper face or an embedded architrave flush with the wall of a structure in which the door frame assembly is mounted. The door assembly may provide a closure or closures for a sliding assembly or part thereof and the like, for example a closure for part(s) thereof disposed in the frame assembly more preferably in the headpiece thereof.

Preferably the door assembly is constructed of anti tamper material, more preferably high strength material such as metal for example steel, engineering composite materials, plastics or polymers, or solid wood and combinations thereof. And/or comprises components configured in manner to confer high strength, such as oversized components. For example composites include multiple phase polymers. Composites and plastics or polymers and wood may be presented as core and skin structures such as solid core construction or generic density core with lipping. Preferably components are configured in manner such that the weight thereof confers strength and yet permits convenient assembly. Preferably the door frame assembly comprises hollow components, most preferably components are constructed in shaped sheet steel and may comprise deformable materials or portions as herein defined. Preferably the door leaf comprises solid wood, metal or engineering composite materials as known in the art and may comprise deformable materials or portions as herein defined.

The door assembly is configured to be received in a support or structure or a support within a structure such as a wall or building, for example in a support opening such as a wall opening, preferably in a reinforced support opening such as a reinforced wall opening, for example an opening in a wall having formwork or studwork thereabout to receive a door assembly, more particularly having oversized formwork or studwork.

Pocket door assemblies are typically provided pre-assembled with the door leaf installed in the pocket. The hereindefined pocket door assembly is provided in two components being a door leaf and a door frame assembly as hereinbefore defined including a pocket configured to receive the door leaf, or in three components being a door leaf, a door frame assembly as hereinbefore defined and a pocket configured to receive the door leaf. Additional fixings and elements including separate overlap elements are provided as additional assembly components. The door assembly is a high strength assembly as hereinbefore defined which, by providing in two parts or three parts as hereinbefore defined facilitates convenient assembly without compromising strength conferred by weight and/or size of components.

In a further aspect there is provided a kit for a door assembly as hereinbefore defined comprising a door frame assembly and a door leaf as hereinbefore defined optionally together with further non-integral components as hereinbefore defined.

In a further aspect there is provided a door frame assembly or component thereof or a door leaf as hereinbefore or hereinbelow defined, preferably for use in a door assembly as hereinbefore defined.

In a further aspect there is provided a method for the manufacture of a pocket sliding opening door assembly, or door leaf, door frame assembly or component thereof as hereinbefore defined.

In a further aspect there is provided a method for installing a door assembly as hereinbefore defined in a support structure having an opening to receive said door assembly, comprising providing the door frame assembly as herein defined, providing a door leaf as herein defined for slideably engaging in said door frame assembly, installing the door frame assembly in the support opening and loading and slideably engaging the door leaf within the door frame assembly. Door frame assembly overlap at door leaf top edge and optionally additionally at door leaf side edges as hereinbefore defined is provided separate to the frame assembly at at least one face thereof. The method comprises further providing an overhead overlap element at at least one door leaf face and optionally additionally providing a closing side jamb providing closing side overlap as herein defined, locating at the door leaf top edge and closing side edges and securing. Securing is subsequent to installing and loading the door leaf.

Preferably a support structure opening is prepared to receive the door frame assembly. In the case of a support structure comprising a wall, formwork or studwork is provided about the opening, being sized and shaped to receive the door frame assembly and secure in place in anti tamper manner. The support structure about the opening and the exposed studwork is then finished by plastering or panelling or other means as known in the art.

The method for assembling a door assembly as hereinbefore defined which is a two part assembly of a door leaf and door frame assembly further comprising one or more separate overlap elements, comprises installing the door frame assembly in a support structure as hereinbefore defined, slideably engaging the door leaf within the door frame assembly, and subsequently positioning and securing the overlap elements.

Sliding door assemblies comprise a sliding assembly. Such sliding assembly potentially presents a ligature risk and/or is vulnerable to tampering. Known sliding assemblies typically comprise one or more elongate track elements and/or one or more sliding elements and means for engagement with the door frame assembly and/or with the door leaf for sliding engagement of door frame assembly and door leaf.

A sliding assembly may be operated or activated manually, electrically or magnetically or any combination thereof as known in the art. In the case of an electrically and/or magnetically operated assembly, such as an electromagnetic drive sliding assembly, for example the Magneo electromagnetic drive operator (Dorma) for door leaves up to 80 KG weight, and corresponding for heavier door leaves or multiple door leaves, components are disposed in relation to the assembly. Preferably the sliding assembly is electromagnetically driven and comprises for example electrical components including circuitry, wiring and/or contacts, electromagnetic components and magnetic components such as solenoids and magnets. Components are disposed along the length of the track element. Such components are vulnerable to tampering, components thereof may also provide a ligature risk.

A track element or elements may be disposed in continuous or intermittent fashion along a headpiece of the frame assembly or along the door leaf at or towards the door leaf top edge. Sliding element(s) may comprise one or more rolling or static sliding surfaces. A track may be located overhead of the door leaf top edge or to one or either side thereof and concealed by the overhead overlap element as herein defined for the purpose of coupling engagement of the door via its top edge to the sliding assembly.

Preferably the sliding assembly comprises an overhead elongate track and a sliding mechanism, more particularly comprises an elongate profile member providing therein one or more overhead elongate tracks, for example two parallel tracks and configured to receive a plurality of sliding elements. Sliding elements may comprise one or more skids, rollers or wheels. The element(s) are configured to be slidingly received within the profile member. Preferably one of said track(s) and sliding element(s) is provided in association with the door frame assembly and the other(s) thereof is provided in association with the door leaf as hereinbefore defined. Preferably the sliding element(s) are received within the profile member in manner to engage with the track. Either of elongate track and sliding element includes separate or integral coupling means for engagement with the door frame assembly or door leaf or both. More preferably elongate track is mounted or mountable to the door frame assembly. Preferably sliding element(s) comprise coupling mean(s) for engagement with the door leaf.

In embodiments a sliding assembly for a door assembly herein comprises an elongate profile member comprising one or more elongate track elements as herein defined and including separate or integral coupling means for engagement with said door frame assembly, said member configured to receive therein, therebetween or thereabout, one or more sliding elements having one or more static sliding surfaces and including separate or integral means for coupling to said door leaf top edge, wherein said elongate profile member is an overhead overlap element as herein defined and wherein said one or more sliding elements are continuous with and separately or integrally coupled with said door leaf thereby providing said door leaf top edge as hereinbefore defined whereby said elongate profile member provides said overlap at two oppositely facing surfaces thereof with said sliding element(s) continuously disposed with said door leaf at the top edge thereof as hereinbefore defined.

Elongate profile member providing one or more elongate tracks on one or more outer surfaces thereof and configured to receive thereabout said one or more sliding elements eliminates a potential ligature points which might be presented between two parallel aligned or converging inner surfaces.

Elongate profile member providing one or more elongate tracks on one or more inner surfaces thereof and configured to receive therein or therebetween said one or more sliding elements comprises low friction surfaces and thereby may eliminate a potential ligature risk.

One or more sliding elements herein are suitably continuous with the door leaf herein and thereby the top edge of said sliding element(s) suitably provides the top edge or part thereof, of said door leaf.

A single sliding element provided in a sliding assembly herein is suitably in the form of a continuous elongate sliding element coextensive with the top edge of the door leaf or with overhead overlap or with that portion thereof remaining outside the pocket in closed and part closed position. Thereby said sliding element presents a continuous elongate top edge of said door leaf and eliminates a potential ligature point which might be presented between at said door leaf between two spaced apart sliding elements. Such sliding element may be comprised in a door assembly herein with or without overhead overlap at the inside face thereof.

The sliding element, or the sliding elements in combination, may comprise the door leaf top edge, in the form of a low friction sliding surface provided on the element or each of the elements.

In embodiments as herein, said elongate profile member is an overhead overlap element and is removably mounted to said frame assembly as hereinbefore defined in manner that removal of said overhead overlap element comprises combined overhead overlap element and door leaf removal as hereinbefore defined. For example said elongate profile member comprises an elongate face or two elongate faces configured to be separately continuous with said headpiece at either or both of two outwardly facing faces of said headpiece, and said elongate profile member comprises recessed attachment fixings for securing to the headpiece and/or sidepiece(s), said fixings having recessed fixing access at said elongate face or faces thereby providing for removeable mounting of said elongate profile member and thereby combined overhead overlap element and door leaf removal.

Combined overhead overlap element removal and door removal herein comprises removal of removeably mounted elongate profile member and thereby of overhead overlap element, to a clear opening face of said door assembly, whereby said door leaf may be simply disengaged from side overlaps as hereinbefore defined and lifted from bottom overlap as hereinbefore defined.

A door assembly as hereinbefore defined may comprise one or more further overhead overlap elements as hereinbefore defined for overlap with the door leaf at either or both faces of said door leaf, and mounted to or integral with said elongate profile member in the case of overlap with the face of said door leaf to which said elongate profile member is removable. In particular in the case that the sliding assembly comprises a plurality of sliding elements with discontinuous overlap.

A sliding assembly comprising slidingly engageable low friction static surfaces herein provides slideable translation of a door leaf as herein defined in relation to a door frame assembly as herein defined.

A low friction static sliding surface suitably comprises material selected from low friction metal such as polished stainless steel or cast bronze and solid lubricant such as low friction composites and low friction polymers, for example PTFE (polytetrafluoro ethylene), nylon, UHMWPE (ultra high molecular weight polyethylene) and combinations thereof, in particular combinations comprising load bearing low friction metal with embedded solid lubricant such as stainless steel with embedded PTFE liner portions or plugs.

In particular a sliding assembly herein comprises an elongate sliding track element comprising integral coupling means for continuous elongate engagement with the door frame assembly along the length of said member, together with sliding elements, said element comprising continuous surfaces herein may comprise a low friction surface as defined, for example a combination of stainless steel and PTFE.

In embodiments the hereindefined sliding door assembly may be configured in manner to conceal and/or prevent access to the sliding assembly thereby preventing ligature at the sliding assembly and/or prevent tampering with the sliding assembly. In embodiments the hereindefined sliding door assembly is configured in manner to permit door override with door locked or barricaded closed, and/or door removal with door locked or barricaded closed. The presently disclosed slide opening door assembly provides a number of preferred or alternative configurations which address and obviate tamper risk and/or ligature risk at the slide assembly in open position and in closed position, as enumerated hereinbelow.

Advantageously door leaf and frame members may be solid core construction or generic density core with lipping.

A door assembly herein is rendered resilient to tamper and ligature in a number of ways, including low tolerances provided at overhead and side overlaps between door leaf and frame assembly, reducing damage risk to door leaf or track by sideways impact at said door leaf and reducing ligature risk by insertion of a ligature between door leaf and frame assembly.

Ligature risk is further reduced herein by provision of one or more seals between said door leaf and frame assembly. A seal herein may be an elongate seal mountable to the door leaf opening side edge and configured to extend outwardly to contact the frame assembly. Such seal may be a magnetic seal configured to contact and secure against the frame assembly, or may be a two part seal which configured to engage with a corresponding seal mounted on said frame assembly. Such seals permit free travel of said door leaf and are configured to activate on closing of said door leaf. Alternatively such seal may be an elongate seal continuous with said door leaf effectively extending the door leaf within the frame assembly, but being deformable whereby installation and removal of said door leaf is not constrained.

In embodiments one or more seals herein comprise one or more wiper seals mounted on either of door leaf and frame assembly and comprising an angled deformable blade, configured and disposed to loosely contact the other of door leaf and frame assembly at an edge or face thereof. The blade is conveniently angled at approximately 45 C or thereabouts. Uniquely in the present context, a wiper blade is disposed to direct towards the direction of any incoming foreign body, and is configured to deform in the direction of the interior of the frame assembly on encountering such foreign body, thereby causing the blade to contact said door leaf or frame assembly with greater force thereby repelling said foreign body.

A wiper seal may be disposed to contact any edge or face of said door leaf, i.e. top, side or bottom. In embodiments a wiper seal is provided at a bottom edge to said door leaf and disposed in manner to loosely contact a bottom piece to the frame assembly, suitably at a raised portion thereof. Such wiper seal is angled outwardly towards the closing side edge of the frame assembly. Said wiper seal thereby prevents entrainment of a potential ligature or tamper device at the door leaf bottom edge, for example in the bottom sliding mechanism.

In further embodiments a wiper seal is provided at pocket side piece to said frame assembly and disposed in manner to loosely contact the door leaf. Such wiper seal is angled outwardly towards the closing side edge of the frame assembly. Said wiper seal thereby prevents entrainment of a potential ligature or tamper device at or in the pocket.

In embodiments herein, a door assembly is further rendered resilient to tampering by sideways impact inflicted at said door leaf, by means of one or more spacers mounted in an overlap as hereinbefore defined, said spacers providing contacting said door leaf at one or more rolling or sliding surfaces. For example a plurality of rollers mounted in said overlap resist sideways impact to said door leaf without impeding sliding of said door leaf.

In further embodiments, the door assembly is provided together with a selection of seals as hereinbefore defined, addressing specific ligature risk and different tamper risk considerations. More particularly the assembly is a non-handed assembly as hereinbefore defined which is further provided with a selection of overhead and/or side overlap elements incorporating same or different seal configurations as hereinbefore defined, and/or a selection of seals as hereinbefore defined said seals addressing specific ligature risk and tamper risk considerations.

In an embodiment the opening pocket comprises a lining, facing and sealing the pocket framework, which may be a removable lining, facing and sealing the pocket framework. Preferably the lining is constructed of polymer or metal which may be antibacterial polymer or metal such as an antibacterial vinyl or coated metal. The lining may be withdrawn for cleaning purpose and reinserted. Alternatively the lining may be cleaned in situ. The smooth walls presented by the lining facilitate effective cleaning from outside the pocket, in manner which would not be possible in the case of exposed frame work. A non removable lining may comprise a sheet welded to the framework. Seals or brush strips may be provided at the pocket opening. Fouling of the lining may be accidental or deliberate. The removable lining facilitates the prevention of dirt accumulation and infection risk.

The lining is preferably in the order of 1 mm-3 mm thick, for example 2 mm thick. In this case it is necessary to increase pocket side wall to door leaf tolerance to accommodate the lining, and values of tolerance as given hereinabove apply to the pocket lining to door leaf tolerance. Preferably pocket sidewall (in absence of lining) to door leaf tolerance is in range 3 mm-14 mm at least at/towards pocket opening e.g. 6 mm-10 mm, ideally 8 mm to each side.

In an embodiment the door assembly is disposed and configured in manner which prevents access to the sliding assembly for tamper purpose or for ligature purpose. The sliding assembly may be provided in one or more cooperating parts as hereinbefore defined. The sliding assembly or its parts are disposed within the door frame assembly headpiece at a top portion of the top overlap or preferably overhead the top overlap.

The overhead overlap is suitably defined as that part of the door leaf overlapped by the overhead overlap element to the headpiece. In the case that the door leaf top edge comprises a part of said sliding assembly in particular a sliding element, having a face thereof coextensive with a face of said door leaf, and coextensive with said door leaf top edge, as hereinbefore defined, the overhead overlap is that part of the door leaf and/or sliding element overlapped by the headpiece or an overhead overlap element to the headpiece, which in turn may constitute a face of a part of the sliding assembly such as an elongate profile member or overhead sliding track element as hereinbefore defined. References herein are correspondingly interchangeable.

The overhead overlap $O^O$ is suitably characterised by overhead overlap height o.h being the height of the door leaf and/or sliding element overlapped by the overhead overlap element or elongate profile member or sliding track element. O.h is the vertical distance between a lower edge of the overhead overlap element or elongate profile member or sliding track element and the top edge of the door leaf and/or sliding element. References herein are to be read in correspondingly interchangeable fashion.

The overhead overlap $O^O$ provides an overhead overlap tolerance o.t. between parallel opposed faces of the overhead overlap element and the door leaf face, i.e. an overlap face of the overhead overlap element and the door leaf face overlapped thereby.

In embodiments herein overhead overlap, closing overlap $O^C$ and side overlap $O^S$ and pocket overlap $O^P$ are in the range from 1.2 cm to 5.5 cm, more preferably from 2 cm to 5.5 cm, more preferably from 2.5 cm to 3 cm or from 3 cm to 5 cm such as for example 2.8 cm, 2.9 cm, 3.0 cm, 3.6 cm, 4.0 cm, 4.4 cm or the like. This is in the case that sliding assembly or its parts lack accessible ligature points or tamper points for example a sliding assembly comprises an elongate profile member providing one or more overhead elongate tracks and configured to receive thereabout an elongate sliding element coextensive with the door leaf top edge or that portion thereof configured to remain outside the pocket in closed and part closed position. Thereby said sliding element presents a continuous elongate top edge of said door leaf and eliminates a potential ligature point which might be presented between at said door leaf top edge between two spaced apart sliding elements.

In embodiments herein o.h. is greater than or equal to 2 cm, more preferably is in a range from 2 cm or 5 cm or 8 cm to 8 cm or 40 cm, more preferably is in a range from 2 cm or 5 cm or 8 cm to 30 cm, such as in a range from 10 cm or 14 cm to 25 cm or 21 cm for example is 15 cm, 16 cm, 17 cm, 18 cm, 19 cm or 20 cm. This is in the case that sliding assembly or its parts present accessible ligature points or tamper points for example a sliding assembly comprises an elongate profile member providing one or more overhead elongate tracks and configured to receive therein or therebetween one or more sliding elements or configured to receive thereabout one or more sliding elements associated with said door leaf and comprising non static sliding surfaces, for example comprising one or more rolling sliding surfaces such as wheels presenting ligature points or tamper points.

We have surprisingly found that oversizing of components may be used to advantage in combination with the top overlap as hereinbefore defined. There is an optimum top overlap height o.h beyond which the overlap element becomes of sufficient surface area to become vulnerable to side impact. However in combination with oversized door, and corresponding oversized frame, the top overlap is adapted to be disposed out of physical reach, or out of physical reach at which any appreciable force can be delivered.

Preferably therefore the oversized door leaf as hereinbefore defined has height D.h in excess of 208 cm such as in the range 212 cm-275 cm, more preferably 220 cm-268 cm, more preferably 224 cm-258 cm or 230 cm to 290 cm, more preferably 240 cm to 290 cm.

In an advantage the door leaf has height D.h in the range 224 cm-258 cm and top overlap height o.h in the range from 8 cm-28 cm such as 10 cm-24 cm, and top (overhead) overlap is disposed at elevation above the floor (clear opening height) of greater than or equal to 216 cm.

In a further advantage the door leaf has height D.h. in the range 230 cm to 290 cm and overhead overlap height is in the range from 2 cm to 8 cm, such as 2 cm to 5 cm. Thereby clear opening height is in the range 222 cm to 288 cm, such as 222 cm to 285 cm.

Preferably overhead overlap tolerance o.t. is less than or equal to 1.2 cm, more preferably is in the range from 0.1 to 1.0 cm, more preferably in the range 0.1 to 0.8 cm such as 0.1 to 0.6 cm for example is 0.2 cm, 0.3 cm, 0.4 cm or 0.5 cm.

Preferably the ratio of o.h. to o.t., o.h./o.t., is greater than or equal to 16, preferably greater than or equal to 20. o.h./o.t need have no upper limit to function as hereinbefore defined. The greater the ratio, the more restricted is access to the sliding assembly.

In a practical limit however a range of o.h/o.t may be envisaged as 20 to 200, preferably 20 to 140, such as for example 30 to 133, 40 to 133 or 50 to 133. Alternatively expressed as the inverse, ratio of o.t./o.h. may be envisaged as less than or equal to 0.06, preferably less than or equal to 0.05, such as 0.05 to 0.005 or 0.05 to 0.0075.

The range of o.h/o.t typically increases with increasing overlap. For example for a door assembly providing overhead overlap in the region of 8 cm, the range of o.h/o.t may be 20 to 40. Alternatively for a door assembly providing overhead overlap in the region of 15 cm, the range of o.h/o.t may be 25 to 50. Alternatively for a door assembly providing overhead overlap in the region of 18 cm, the range of o.h/o.t may be 30 to 60. Alternatively for a door assembly providing overhead overlap in the region of 24 cm, the range of o.h/o.t may be 30 to 80. Alternatively for a door assembly providing overhead overlap in the region of 32 cm, the range of o.h/o.t may be 40 to 110. Alternatively for a door assembly providing overhead overlap in the region of 40 cm, the range of o.h/o.t may be 50 to 130.

Access to the sliding assembly between the overhead overlap element and the door leaf in closed position is determined as a function of the ratio o.h/o.t and is expressed as overlap angle o.a being the angle subtended by a straight line, herein the maximum access line al., which contacts the top edge of the door leaf and the lower edge of the overlap element. o.h, o.t. and a.l form a right angled triangle. o.a. is thus defined as $\tan^{-1}$ (o.t./o.h.) or $\tan^{-1}$/(o.h./o.t.).

The location of the sliding assembly overhead of the overhead overlap, preferably disposed centrally above the door leaf or offset towards the "outside" face of the door leaf as hereinbefore defined, determines the angle o.a required to prevent an object inserted between the overhead overlap element and the door leaf from accessing the sliding assembly located overhead of the door leaf top edge. Preferably the angle o.a. is less than or equal to 30°, more preferably in the range 25° to 0.2°, more preferably in the range 20° to 0.2°, more preferably in the range 15° to 0.2°, more preferably in the range 10° to 0.2°, more preferably in the range 8° to 0.2°, more preferably in the range 4° to 0.2°, more preferably in the range 2.9° to 0.4°, such as for example 1.71° to 0.44°, 1.43° to 0.44°, 1.145° to 0.44°.

For example for a door assembly providing overhead overlap in the region of 8 cm, the range of angle o.a. may be 2.86° to 1.43°. Alternatively for a door assembly providing overhead overlap in the region of 15 cm, the range of angle o.a may be 2.29° to 1.145°. Alternatively for a door assembly providing overhead overlap in the region of 18 cm, the range of angle o.a may be 1.71° to 0.91°. Alternatively for a door assembly providing overhead overlap in the region of 24 cm, the range of angle o.a may be 1.71° to 0.71°. Alternatively for a door assembly providing overhead overlap in the region of 32 cm, the range of angle o.a. may be 1.43° to 0.51°. Alternatively for a door assembly providing overhead overlap in the region of 40 cm, the range of angle o.a may be 1.145° to 0.44°.

The minimum angle o.a may decrease with increasing thickness of the door leaf. In the case of a door assembly having a single face at risk of ligature or tampering, the angle o.a. decreases with a sliding assembly positioned at or towards one side of the door leaf remote from the face thereof presenting ligature or tamper risk.

In an embodiment at least one overhead overlap element is provided separately and is secured in position in relation to the door frame assembly after loading the door leaf in the door frame assembly. Preferably securing is by means of anti tamper and anti ligature fixing means.

Preferably an overpanel is removably mounted to the clear opening face of said frame permitting access for maintenance or door override.

The frame assembly may provide an overhead overlap element to each face of said door leaf, one thereof being secured in antitamper manner, and the other thereof being secured for external maintenance and door override access. Preferably the frame assembly is non-handed, comprising two overhead overlap elements for securing each to a face of the frame assembly, by securing fixings which are at one face non-removable for antitamper purpose, and at the other removable, for purpose of maintenance/door override/door lock open/door lock close panel and door removal, that is to say door lock close overhead overlap element and door removal.

In embodiments said overhead overlap elements are interchangeable to either face and securable each with one of two fixings being securable to either face and being a removable fixing and a secure fixing (e.g. screw, bolt); or are different, one being securable with a removable and one with a secure fixing to either face; or are interchangeable and securable each with either of two fixings to either face.

In one embodiment of the pocket slide opening door assembly defined herein the overpanel(s) comprises recessed attachment fixings for securing to the headpiece and/or sidepiece(s), said fixings having recessed fixing access.

In an embodiment the headpiece and/or sidepiece(s) comprise projecting elongate flanges and the overpanel(s) comprise mating slots, said flanges and slots mateable by sliding insertion of said overpanels from a first direction, said overpanels and headpiece and/or sidepiece comprising recessed fixing means to prevent unauthorised reverse detachment. Preferably flanges and slots are provided on adjoining faces of the frame assembly and overhead overlap element which are vertically disposed in use, and sliding insertion is upwardly directed, from within the clear opening.

In one embodiment a slide opening pocket door assembly provides a side overlap $O^S$ with the door leaf at both side edges thereof, with the door leaf in closed position and provides a side overlap $O^S$ with the door leaf at one side edge thereof, with the door leaf in open or part open position.

In said embodiment the overhead overlap element may be a top rail, for locating at a face of said headpiece and/or sidepiece(s) and seating by means of fixing means provided in a headpiece and/or sidepiece face(s) and thereby concealed within the headpiece and/or sidepiece(s) and top rail.

Preferably the overhead overlap element and a face of the door frame assembly against which it is to seat comprise means for mutual seating and fixing comprising one or more elongate grooves or routered channels and one or more projecting flanges provided in a plane including the loaded door leaf thereby providing reinforcing in said plane.

When joining components in a structural assembly, there is a concern that joints and fixings therefor might serve to introduce weak points reducing the performance of the structure under load. In a particular advantage we have found that elongate seating means as hereinbefore defined effectively distribute load applied to the overhead overlap element over the area of the seating means. Moreover seating means may be comprised of material of equal or greater performance under load to that of the overlap element and thereby enhance its performance under load. Preferably elongate seating means are made of steel. Preferably elongate seating means comprise elongate L-sections or T-sections which may be secured or welded to one of said frame assembly and said top overlap element, and received in a routered channel or groove in the other thereof.

Alternatively elongate seating means comprise elongate double inverted L-sections or T-sections (variant X-sections) which may be received in a routered channel or groove in both said frame assembly and said top overlap element.

The assembly provides further fixing means for securing the overhead overlap element in seated position. Preferably fixing means comprises a plurality of components recessed within one of the sidepiece and the overhead overlap element, and adapted to be advanced to be received within a recess in the other thereof, preferably recessed within the overhead overlap element and adapted to be advanced to be received within a recess in respective sidepieces. The component is suitably a locking bolt. Advancing is suitably by means of a key for manually advancing and retracting the locking bolt. A guide hole is suitably provided in the lower face of the overhead overlap element extending upwardly into the element for the purpose of extending a key upwardly within the hole and engaging the bolt.

Preferably in said embodiment the assembly is provided in a plurality of parts for assembly in situ, comprising: in a first part the door leaf; in a second part the door frame assembly with bay or pocket configured to receive the door leaf; or in second and third parts the door frame assembly and separate bay or pocket configured to receive the door leaf; together with at least one overhead overlap element provided in one or more further part or parts; wherein said assembly prevents ligature about the door leaf top edge, and prevents access to the sliding assembly for tamper purpose or for ligature purpose; wherein top overlap $O^T$ provides top overlap height o.h. being the height of the door leaf overlapped by the overhead overlap element, wherein o.h. is as hereinbefore defined for example in a range of from 1.2 cm to 5.5 cm or 2 cm or 5 cm to 40 cm or is greater than or equal to 8 cm for example in a range from 8 cm to 40 cm; and wherein the sliding assembly or its parts are disposed within the door frame assembly at a top portion of the top overlap or overhead the top overlap.

Alternatively securing may be by fixing means introduced at or accessed from an exposed face, preferably a lower face or edge of the overhead overlap element, more preferably a substantially horizontal face thereof, within a presunk hole therein and seating in a face of the door frame assembly adapted to receive the overhead overlap element for example in the case of a hollow door frame assembly, seats in a lower face thereof. A presunk hole restricts ligature and tamper access. Preferably the overhead overlap element and lower face of the door frame assembly against which it is to seat comprise mutual seating means, for example mating presunk locating and fixing holes. Preferably in the case of a hollow overhead overlap element, guide means is provided between the presunk fixing hole and an opposing seating for fixing means. We have found that this facilitates in admirable manner manually locating the opposing seating for the fixing means.

In embodiments the overhead overlap element is a top rail, more preferably is a hollow rectangular, trapezoidal, radiused or part radiused (at one face, such as an upwardly disposable face) or like cross section element having o.h as hereinbefore defined. Preferably the overhead overlap element is an oversized element conferring anti tamper strength, having overlap element depth or thickness in the range 3 cm to 9 cm, for example in the range 5 cm to 8 cm, such as 6 cm, 7 cm or 8 cm.

In embodiments the overhead overlap element is located at a lower substantially horizontal face of a headpiece as hereinbefore defined. Preferably the seating for fixing means is provided in the lower headpiece face. Such seating is thereby concealed within the headpiece and overhead overlap element.

Alternatively the overhead overlap element, is secured by means of one or more flanges projecting therefrom for receiving in mating routered channels in the body of the frame assembly for example a headpiece, or disposed in opposite arrangement with flanges projecting from said headpiece or sidepiece and mating with routered channels in said overpanel. Preferably 1 flange is disposed horizontally with matching routered channels along the overpanel and/or headpiece and 2 flanges disposed vertically with matching routered channels along the overpanel and vertical frame members. Preferably one or more flanges are disposed vertically in each vertical frame member, for example each sidepiece. Flanges may be steel, and may be welded or screwed to the frame or overpanel.

In embodiments the overhead overlap member is solid core construction or generic density core with lipping as hereinbefore defined. Such structure provides a robust material and provides required strength for locating and fixing as defined.

The door assembly as herein defined provides an overhead overlap as herein defined with the door leaf in closed position or in partially closed position. Alternatively or additionally the door assembly provides an overlap void with the door leaf in open or partially open position. An overlap is disposed adjacent to an overhead overlap void V° in the case of partially open or partially closed position.

The overlap void has height V°.h corresponding to the sum of overlap height o.h. as hereinbefore defined and a distance between door leaf top edge and sliding assembly. Overlap void depth or thickness V°.d is preferably in the range 3 cm to 8 cm, more preferably 5 cm to 7 cm, such as for example 5.5 cm, 6 cm or 6.5 cm. Overlap void depth or thickness corresponds to the sum of door leaf thickness and overhead overlap tolerances o.t to each face. Overlap void prevents access to the sliding assembly. For example access is only possible with use of an implement of length in excess of o.h as hereinbefore defined. Such implements are unavailable in ligature risk environments.

The dimensions of the sliding assembly track must be accommodated within the overlap void dimensions. In embodiments therefore the sliding assembly track is narrow gauge, preferably of width in range 2.1 cm to 4.6 cm, more preferably 2.3 cm to 4.1 cm, such as for example 2.7 cm or 3 cm or thereabouts. Advantageously a narrow gauge track facilitates concealing the sliding assembly in a narrow aperture overlap void overhead of a door leaf top edge. This further facilitates restricting access to door leaf top edge and/or sliding assembly, in anti ligature and anti tamper manner.

Assembly in situ may be complicated by the dimensions of the overlap void and/or dimensions of the oversized door leaf which exceed the dimensions of the clear opening or doorway into which the door leaf is to be received. In the herein defined slide opening door assembly, a sidepiece to the frame assembly preferably comprises a preloading cavity lining element providing a preloading cavity having depth and width which facilitates receiving the door leaf at its closing side edge with its pocket side edge initially out of alignment, bringing the door leaf into alignment and securing and sliding into the pocket; said preloading cavity having depth and width in excess of side overlap element overlap depth and width and thus dimensioned to receive said side overlap element; wherein said frame assembly further comprises coupling means for securing said frame assembly to said sliding assembly by couplingly advancing said door leaf in a plane including said sliding assembly and said aligned door leaf; and wherein a vertical separation between loaded door leaf top edge and sliding assembly is in the range from 5 cm to 12 cm, such as 6 cm to 14 cm, preferably 6 cm to 10 cm, more preferably 6.5 cm to 9.5 cm.

Said vertical separation defines the height of an overlap void as hereinbefore defined with the door leaf in open or partially open position, wherein height ov.h corresponds to the sum of the overlap height o.h and the distance being the vertical separation between door leaf top edge and sliding assembly. In embodiments therefore overlap void height ov.h is in the range in excess of 2 cm+(5 cm to 14 cm)=in excess of 7 cm to 14 cm, more preferably in the range (2 cm to 40 cm)+(5 cm to 14 cm)=7 cm to 54 cm, more preferably in the range (5 cm to 40 cm)+(5 cm to 14 cm)=10 cm to 54 cm, more preferably in the range (8 cm to 40 cm)+(5 cm to 14 cm)=13 cm to 54 cm.

Commercially available slide opening door assemblies strive to minimise the separation of the sliding assembly and door leaf, not least for cosmetic reason. To increase this separation would simply complicate the design. In the present assembly, the requirement to preload the door leaf and engage in the direction of the door leaf, rather than perpendicular thereto, creates a fiddly operation. We have surprisingly found that the presently claimed assembly having oversized top overlap element advantageously accommodates a greater separation of sliding assembly and door leaf top edge, without the need to redesign for cosmetic or other purpose, and admirably facilitates loading.

In embodiments, a sliding assembly comprises a plurality of sliding elements comprising rolling or static sliding surfaces as hereinbefore defined wherein coupling means for engagement with the door leaf herein comprise door hangers, and the door assembly herein provides overlap void to accommodate door hanger length. In embodiments the overlap void accommodates door hangers of extended length. Preferably in the case of overlap void having height in range 60 mm-140 mm hangers are provided having length in range 60 mm-140 mm, simplifying mounting of door leaf.

Components of any sliding assembly may require replacing from time to time due to wear or damage. For example hangers are consumable and have a risk of failure and thus have a lesser life time than the door assembly. Sliding assemblies may also jam, derail or otherwise fail. In a further embodiment the pocket slide opening door assembly comprises a removeable sliding assembly track.

In embodiments a removeable sliding assembly track or track element herein is that portion of a sliding assembly configured for mounting in the clear opening of the herein frame assembly. Such removeable sliding track element may comprise mounting means provided in the headpiece comprise mating components mountable by a push fit, sliding fit and/or drop fit mechanism, for example as hereinbelow defined, and concealed in anti ligature and anti tamper manner by said overhead overlap as hereinbefore defined.

Alternatively such track element comprises recessed attachment fixings for securing into the headpiece or side piece to the frame assembly as hereinbefore defined.

In embodiments said track element is separately or integrally coupled with an overhead overlap element as hereinbefore defined or constitutes an overhead overlap element as hereinbefore defined, and comprises recessed attachment fixings for securing into the headpiece or side piece to the frame assembly as hereinbefore defined.

In embodiments track element coupled with or constituting said overlap element, is mountable to said headpiece, by fixings to headpiece or sidepiece as hereinbefore defined, and is substantially coextensive with the headpiece face to which it is mountable, thereby eliminating any headpiece profile irregularities above said clear opening. Alternatively said track element is coextensive with a portion a face of said headpiece to which it is mountable, and a further profile element which is coextensive with the remaining portion of said headpiece face is mountable to said track element or to said headpiece, and is removeably mountable with said track element or otherwise. Said further profile element may constitute an overlap element to a barricade face of said door assembly as hereinbefore defined.

A removeably mountable overhead overlap element comprising a sliding track element as hereinbefore defined may have a profiled face for mounting to a mating profiled headpiece at a face thereof, for example for higher elevation of interface therebetween at said clear opening face than internally within said clear opening or at said opposite barricade face. This facilitates tilting of door leaf from said frame assembly, said door leaf being in sliding engagement with said track element, whereby removal of said track element provides for removal of said door leaf. This would render the assembly handed, with associated disadvantages as hereinbefore defined. Accordingly in a further embodiment, the assembly herein is a handed assembly as hereinbefore defined and is provided with a universal headpiece of irregular cross section, or with a selection of headpieces of mirror image cross section. More particularly a headpiece may be radiused or part radiused at a face thereof to be downwardly disposed so as to seat against one or more overhead overlap elements herein, or, or similarly trapezoidal or part trapezoidal cross section, one face thereof being non right angled with respect to the other three sides. Said headpiece is suitably configured for assembly to provide said door frame assembly, as a profiled headpiece, with lower elevation to either of an outside face or inside face of said door assembly, to be disposed in left handed or right handed configuration having regard to the relative positioning of pocket and clear opening.

In further embodiments a removeable sliding assembly track or track elements herein is that portion of a sliding assembly configured for mounting in the pocket of the herein frame assembly. Preferably the sliding assembly track comprises means at a pocket end thereof for mounting to corresponding mounting means provided internally within the pocket. Mounting means may be provided at a pocket inside remote wall or ceiling or part thereof, such as pocket framework. Preferably mounting means provided within the pocket comprise mating components mountable by a push fit, sliding fit and/or drop fit mechanism such as an L plate mounted on a pocket side wall or rear wall for receiving a corresponding projecting lip provided on the track, supported thereon. Preferably additional mounting means are provided for securing the track within the pocket by a further push fit, sliding fit and/or drop fit mechanism. For example one or a plurality of mushroom heads projecting upwardly from the track are adapted to be received in a corresponding number of keyhole slots provided in the headpiece, as illustrated in FIG. 8C. A mushroom head received in a keyhole is retained by advancing the track, and the mushroom head, to seat in the narrowed portion of the slot. Equivalent mounting means may be envisaged and are within the scope of this invention. The closing end of the track may comprise any suitable means for locating in the sidepiece. Preferably additional mounting means are provided for securing the track within the overlap void, more particularly securing in advanced state engaged at the one or more keyhole slots. Tooled access is available, by special tool within the overlap void, or by normal tool prior to securing the overhead overlap element(s) in place. Accordingly such mounting means may be any antiligature anti tamper means and preferably comprises one or more fixings such as screws tapping upward into the head piece within the overlap void.

In a further aspect there is provided a method for locating or removing the sliding assembly track within the opening pocket. Preferably the method comprises elevating one end and lowering the other track end, bringing within the clear opening and inserting the pocket end into the pocket, raising into horizontal alignment, locating the remote pocket end mounting means and mushroom heads, advancing to engage and screwing into the headpiece. Removing comprises reversing the method.

The door assembly herein suitably comprises one or more dampers configured to decelerate the sliding door leaf approaching closed position or open position or to absorb impact of sliding door on door assembly at moment of reaching closing position or open position.

In embodiments, the door assembly herein may comprise a bidirectional damper or two opposing dampers outwardly facing, for example located intermediate a pair of sliding elements. Such damper(s) assists in preventing damage being sustained to the track as a result of abuse and in preventing injury.

Preferably a closing damper herein provides deceleration in a damping distance or amplitude at closing side edge in a range from 15 cm or 20 cm up to 30 cm, preferably up to 25 cm for example in the range from 15 to 20 cm. Such distance or amplitude is sufficient to reduce the risk of serious injury in case of an individual being struck by a closing door leaf, and in particular in case of said individual's head being struck by said closing door leaf.

In embodiments herein a closing damper is selected from a pocket mounted damper having damping amplitude comparable to the clear opening, for limiting door leaf speed and closing force in said clear opening or for limiting door leaf speed approaching the closing side edge, for example selected from an inertia reel damper, such as is well known in products such as seat belts, self belaying devices and the like, a rigid or flexible tether, a rack and pinion damper, an overhead buffer and stop combination spaced apart to permit permitting long buffering amplitude as hereinbefore defined, a side edge mounted or side piece or end piece mounted elongate buffer as hereinbefore defined, and the like.

A pocket mounted damper is suitably disposed in said pocket, one end thereof mounted at or towards the pocket opening end piece and the other end thereof configured for attaching to said door leaf at or proximal to the opening side edge thereof, and within the pocket overlap portion or overhead overlap portion of said door leaf.

A pocket mounted inertia reel locking damper suitably comprises an inertia reel, said reel tethering an elongate webbing or tape at one end thereof, said webbing or tape attaching at other end thereof to said door leaf at or near the opening side edge thereof. Such inertia reel permits the webbing or tape to be drawn out at an acceptable speed, and thus the door leaf to move at an acceptable speed, but locks under excessive load. An inertia reel may comprise the option to adapt sensitivity according to weight of door leaf, and risk of tampering. A pocket mounted rigid tether may be telescopic or hinged, and comprises a plurality of elongate members, hinged or telescopically linked in manner to elongate and contract.

A rack and pinion or spaced apart buffer and stop damper permit long damping amplitude as hereinbefore defined, and are suitably disposed along the door leaf top edge and within the overhead overlap portion thereof.

In embodiments herein a damper comprises a resiliently deformable elongate buffer disposed along an entire door leaf edge or frame assembly sidepiece or end piece more particularly provided in the form of a resiliently deformable elongate door leaf pocket side edge or door leaf closing side edge or frame assembly closing sidepiece or pocket end piece, also termed opening end piece, or a combination thereof, as hereinbefore defined. Such elongate buffer or combinations of elongate buffers conveniently absorbs tampering impact resulting from violent closing action or opening action of said sliding door leaf.

Said resiliently deformable elongate buffer is suitably disposed at door leaf closing edge or frame assembly closing side piece. Door assembly comprising said closing elongate buffer suitably reduces risk of injury to an individual if caught in said clear opening during closing of said door leaf. For example an individual attempting to self harm might attempt to place him or herself in the way of said closing door leaf.

A resiliently deformable elongate buffer is suitably comprised of resiliently deformable materials, more particularly compressible material which compresses under impact and regains its configuration on removal of impact force. Said compressible material may avoid rebound of closed door leaf, which might result from damping with an elastic material. An ideal material is soft and cushioning and also sufficiently resilient to resist damage by manually pulling apart or by penetrating with a soft or blunt implement.

The elongate configuration of said buffer is suited for the present antitamper and antiligature application, and is less susceptible to damage and to ligature than might be one or a plurality of stopper shaped buffers interspersed along an edge or side piece herein.

In embodiments, a door assembly herein comprises in combination a pocket mounted inertia reel damper and a closing side edge resiliently deformable elongate buffer.

In the presently claimed pocket door assembly the pocket may be dimensioned to receive the entire door leaf, preferably such that the door leaf is flush with the pocket or is recessed within the pocket. The door leaf may thereby be received within and enclosed by the pocket in open position and thereby concealed and rendered inaccessible.

i.e. The pocket may be dimensioned to receive the door leaf in full in open position, the pocket being partially occupied by the door leaf in partially open position.

A further complication arises in delivering the door frame assembly for assembly, which is the oversizing of the frame assembly, such that the dimensions of the assembly comprising the pocket exceeds the dimensions of standard access clear openings. These problems might be overcome by providing the door frame assembly as a number of separate components for assembly in situ. This is not only labour intensive and thus costly, but presents complications in aligning very precisely positioned fixing points, which might moreover have become disturbed or distorted in delivery and handling.

A solution to delivering a pocket frame assemblies into and through a building having similar door clear opening heights as the assembly might be to tip the assembly forward allowing it to pass through clear openings. The present oversized door and assembly precludes this possibility. An alternative might conceivably be to rotate the assembly onto a side edge, the combined pocket and frame assembly width being less than standard door clear opening heights. The present oversized door leaf has a width in excess of 75 cm, preferably in excess of 80 cm, for example in the range 80 to 105 cm, more preferably 80 to 95 cm. A correspondingly oversized pocket receiving the entire door leaf presents a door frame assembly of width in excess of 2 m. Again this solution is thereby precluded. Such pocket and frame assembly cannot be readily delivered to site in a single component as both the height and width exceed that of typical access doorways. We have however found that by dimensioning the pocket to receive the door leaf in part only, in open position, or where the pocket is fully occupied by the door leaf in partially open position, the assembly width may be reduced to less than 2 m, whereby the assembled pocket and frame assembly may be delivered as a single component to site, rotated onto its side. Preferably the pocket depth from pocket entry to base of pocket is less than door leaf width D.w. Preferably the door frame assembly has total width less than its total height, more preferably less than 2 m. Preferably pocket depth is in the range 68 cm to 85 cm, for example 70 cm to 78 cm. In such assembly the door leaf would project from the pocket, in fully open position, by an amount in the range 8 cm to 18 cm. Preferably total frame assembly width is in the range 175 cm to 198 cm.

Preferably the door frame assembly is packaged for delivery rotated onto its side. In a further aspect there is provided packaging for a door frame assembly as hereindefined, more preferably for delivery rotated onto its side. Packaging may include orientation indicator and critically positioned support and/or cushioning to hold the assembly in position and/or protect from damage.

In a further aspect there is provided a delivery device comprising a wheeled trolley for delivery through a doorway, comprising a wheeled base having length corresponding to frame assembly height as hereinbefore defined, and width less than conventional door clear opening width and having height less than 2 m, preferably height is greater than 1 m, more preferably in the range from 1 m to 2 m, for example on one or both trolley side edges. In a further aspect there is provided an assembly tool for loading the door leaf, comprising a gripper for holding the door while mounting the door leaf to coupling means for engagement with the track assembly, A further problem arises in the case of delivery of frame assembly and packaging for delivery rotated onto its side, which is the need to support the sidepieces of the frame assembly distal from the headpiece, against any misalignment, with pocket or sidepiece uppermost and loading the headpiece in a direction in which is not intended to be load bearing in use. The assembly may therefore further comprise a door frame assembly bottom piece disposable across the door frame assembly and slideably engageable with the door leaf lower edge. Such bottom piece provides support to the structure. Preferably the bottom piece is provided integral with the frame assembly, more preferably connected in anti ligature and anti tamper manner at the sidepieces.

A further complication arises in delivery of frame assembly and packaging for delivery rotated onto its side, which is the need to support the pocket frame against any misalignment and distortion. Preferably the pocket comprises horizontal steel framework bracing to the vertical steel frame work. Horizontal framework may be disposed in the height of the pocket or at its overhead and base or a combination thereof. By this means the pocket is rendered resilient to flex and deformation during delivery.

The door assembly may comprise one or more shielding elements which restrict access within the overhead overlap void to the sliding assembly or its parts. A shielding element may be static or dynamic, flexible, resiliently deformable, conformable or rigid or any combination thereof.

A shielding element may comprise one or more constriction members which restrict access within the overlap or overhead having regard to the overlap and which restrict access to the sliding assembly or its parts. Constriction member(s) may be selected from one or more elongate flanges, ribs or the like, disposed in manner to create a constriction therebetween or between a constriction member and a face of the frame assembly, of the overlap member, of the door leaf or the sliding assembly. Preferably, constriction member(s) comprise two inwardly disposed flanges or a single elongate flange or spacer. The constriction member may be disposed along a surface comprised within the overlap such as for example along an inner surface of the overlap or the frame assembly, or along the door leaf at or towards the top edge thereof or in association with the sliding assembly or a combination thereof. For example a constriction member may be configured for embedding in a guide groove or a pair of guide grooves provided along an inner surface or opposing inner surfaces of an overhead overlap element and below an overhead sliding assembly.

Constriction members may be rigid or flexible such as resiliently deformable. One or more rigid constriction members may provide an elongate constricted aperture for sliding engagement of the door leaf with the sliding assembly. One or more flexible or resiliently deformable constriction members may provide an elongate dynamic constricted aperture which allows passage of sliding engagement means or sliding coupling means therebetween or thereabout and which encloses the sliding assembly above the door leaf and above the overlap void alike.

Alternatively or additionally the door assembly comprises dynamic shutter means disposable in manner to enclose the sliding assembly. Preferably dynamic shutter means are configured in manner to advance along the elongate track with the advance of the door leaf towards open position. Preferably dynamic shutter means are configured in manner to return along the elongate track with the return of the door leaf towards closed position. Dynamic shutter means may engage with the door leaf top edge or sliding engagement means or the like. Engagement may enable advance of shutter means responsive to advance of the door leaf and/or may facilitate a secure tamper proof enclosure about the sliding assembly. Dynamic shutter means may comprise or be associated with biasing means to retract along the elongate track, for example biasing means may be disposed within the door frame assembly at a side edge thereof, such as within a side edge thereof, more particularly within or concealed by a side jamb or closing jamb. Biasing means suitably comprises a reel style configuration, for drawing in and rolling said shutter means therewithin. Alternatively dynamic shutter means may comprise a flexible plastic tape or filler which is configured to advance and retract with the advance and return of the door leaf, said advancing optionally being along and embedded in one or two guide grooves disposed on an inner surface of an overhead overlap element as hereinbefore defined, and to retract within a groove or aperture extending within the closing side piece on closing of said door leaf.

Alternatively dynamic shutter means comprises a telescopic configuration of shutter sections, which extend by telescopic action with opening of door leaf and retract within an aperture in said door leaf, with closing of said door leaf.

Dynamic shutter means are of particular advantage in restricting access to the sliding assembly, more preferably a sliding mechanism such as a drive mechanism as hereinbefore defined or component thereof with the door leaf in open or partially open position. Accordingly a ligature and/or tamper vulnerability inherent in sliding door assemblies is addressed in admirable and versatile manner.

In the corresponding method for assembling the door assembly as herein defined there is provided a method comprising providing the door frame assembly, the door leaf and the sliding assembly, loading the door leaf in the door frame assembly, and bringing the door leaf and frame into coupling engagement by means of the sliding assembly wherein the method comprises subsequently securing at least one overhead overlap element and closing side jamb provided as a separate component.

The present slide opening door assembly moreover overcomes the disadvantage of access to door leaf top and side edges presented by a hinge opening door leaf in closed position. Specifically a slide opening door assembly enables concealing the door leaf top and side edges within the door frame assembly. Conventionally slide opening door assemblies may be provided in a single unit with door leaf preloaded within the frame assembly. The door assembly of the present invention is provided in two parts being the door frame assembly and the door leaf, either or both comprising components of the sliding assembly. The presently disclosed slide-opening door assembly provides a number of preferred or alternative configurations which facilitate providing such assembly and method for assembly thereof, as enumerated hereinbelow.

Accordingly in a further embodiment there is provided a door assembly as hereinbefore defined which is a pocket door assembly comprising a door frame assembly as hereinbefore defined, a door leaf as hereinbefore defined wherein the door frame assembly provides a pocket to receive the door leaf in open position, wherein the assembly is provided in a plurality of parts for assembly in situ, comprising in a first part the door leaf, in a second part the door frame assembly with bay or pocket configured to receive the door leaf, or in second and third parts the door frame assembly and separate bay or pocket configured to receive the door leaf, together with at least one overhead overlap element provided in one or more further part or parts and wherein the door assembly provides top overlap as hereinbefore defined and wherein the door assembly further comprises a closing side jamb providing closing overlap at one or both door leaf faces. Preferably closing overlap $O^C$ side overlap s.o. (b) at the closing jamb and pocket overlap $O^P$ side overlap s.o. (c) at the pocket opening are in the range from 1.2 cm to 5.5 cm, more preferably from 2 cm to 5.5 cm, more preferably from 2.5 cm to 3 cm or from 3 cm to 5 cm such as for example 2.8 cm, 2.9 cm, 3.0 cm, 3.6 cm, 4.0 cm, 4.4 cm or the like. Preferably side tolerances correspond to overhead tolerances as hereinbefore defined. For example closing jamb tolerance cj.t are independently in the range from 0.1 to 0.6 cm.

Preferably the side piece comprises a preloading cavity lining element preloading cavity liner configured to be received in an opening in a support structure and providing a preloading cavity width pc.d. and the closing overlap element comprises a single part providing overlap at both door leaf faces. Preloading cavity lining element has depth and width greater than side jamb depth and width and enables loading the door leaf at closing side edge with pocket side edge initially out of alignment, bringing door leaf into alignment and securing and sliding into pocket, thereafter positioning and securing closing side jamb with closing overlap tolerances as hereinbefore defined.

Such door frame assembly facilitates providing door leaf and overhead overlap element as hereinbefore defined and side overlap at both door leaf side edges, in manner that facilitates in situ loading of the door leaf without compromising tolerances. This is particularly advantageous in preventing tampering by impact and/or ligature. More particularly the door assembly is able to withstand impact without sustaining damage and/or ligature may be prevented about the door leaf top edge and/or sliding assembly. Preferably the door frame assembly is configured to receive the door leaf with overhead overlap tolerance as hereinbefore defined and more preferably with corresponding side overlap tolerances. Tolerances as hereinbefore defined serve to preclude a gap between door leaf and frame assembly and further prevents ligature between the door leaf and frame.

Preferably the closing side jamb is configured and secured in manner to withstand side impact exerted to the door leaf manually by a human, by means of securing to preloading cavity lining element intermediate at least two supported points thereof.

Preferably a door leaf as hereinbefore defined has thickness in the range 4 cm to 6 cm such as for example in the region of standard thicknesses 4.4 cm to 4.9 cm or 5.4 cm to 5.9 cm. A door leaf may comprise surface facings or coverings for cosmetic or protective purpose. Preferably preloading cavity depth b.d is in the range 6 cm to 9 cm, for example 6.9 cm to 7.8 cm such as 7.2 cm, or in the range 7.9 cm to 8.8 cm such as 8.2 cm. Preferably closing jamb depth j.d. is in the range 4.6 cm to 7.5 cm, for example 5.2 cm to 7.0 cm such as 5.5 cm or in the range 5.2 cm to 8.0 cm such as 6.5 cm. Preferably closing side jamb provides closing overlap tolerances corresponding to overhead overlap tolerances as hereinbefore defined.

In the corresponding method for assembling the door assembly as herein defined there is provided a method comprising providing the door frame assembly overhead piece and sidepiece in a first part, securing in a support structure opening as hereinbefore defined, providing and installing the sliding assembly, providing and installing a preloading cavity lining element as herein defined and providing the door leaf, loading the door leaf in the door frame assembly, and bringing the door leaf and frame into sliding engagement by means of the sliding assembly, sliding the door leaf into open or partially open position, locating and securing at least one overhead overlap element and the closing side jamb subsequent to sliding the door leaf into partially open position. Overhead and side overlap elements may be secured in sequence or simultaneously.

The assembly and method provide for overlap and tolerances as hereinbefore defined in a multiple part assembly for in situ loading of door leaf as hereinbefore defined.

The door assembly as hereinbefore defined may comprise a door frame assembly bottom piece disposable across the door frame assembly and slideably engageable with the door leaf lower edge as known in the art. In a further embodiment the door assembly comprises a slideably engageable door frame bottom piece wherein the bottom piece or door leaf provides a sliding assembly engageable with door leaf and bottom piece. A sliding assembly preferably comprises a sliding element as hereinbefore defined. The assembly of this embodiment is particularly advantageous in providing robust and smooth sliding of an anti tamper door assembly as hereinbefore defined, more particularly an oversized door assembly provided in high strength materials to withstand impact.

A sliding element may comprise the lower edge of the door leaf which comprises a flange, rolling mechanism or routered channel for seating in a corresponding routered channel or flange of a floor track bridging the clear opening. The track may be raised or recessed and may be profiled to prevent trip hazard.

The door assembly is typically for use as an internal door such as a bathroom door, bedroom door or en suite and as such it might be expected that any locking or security requirement would be simply to lock the door leaf in closed position for privacy, whereby a conventional locking bolt as known in the art shooting into the closing sidepiece would suffice. In the present context of violent or vulnerably individuals however there may be a need to lock the door leaf in open or closed position. Moreover a locking bolt arrangement may present a ligature risk. Accordingly the door assembly may comprise a bolt recessed within the door leaf and means for advancing the bolt to extend vertically out of the door leaf from the lower edge of the door leaf and means for retracting back into recessed position, together with a corresponding aligned aperture in the floor track adapted to receive the bolt in advanced position. Preferably means for advancing the bolt is key operated, and is recessed within the door leaf. An access aperture suitably extends to a side edge or face of the door leaf for access via a key having shank or stem of suitable length, such as in the range 1.5 to 3 cm length. One or a plurality of apertures may be disposed along the track allowing multiple lock positions. Apertures may be any shape and configuration which serves to retain the bolt, and thereby the door leaf, in locked position.

DRAWINGS

The assembly is now illustrated in non-limiting manner with reference to the figures, all of which are cross-section views unless otherwise indicated, wherein.

DETAILED DESCRIPTION

Figure 1:
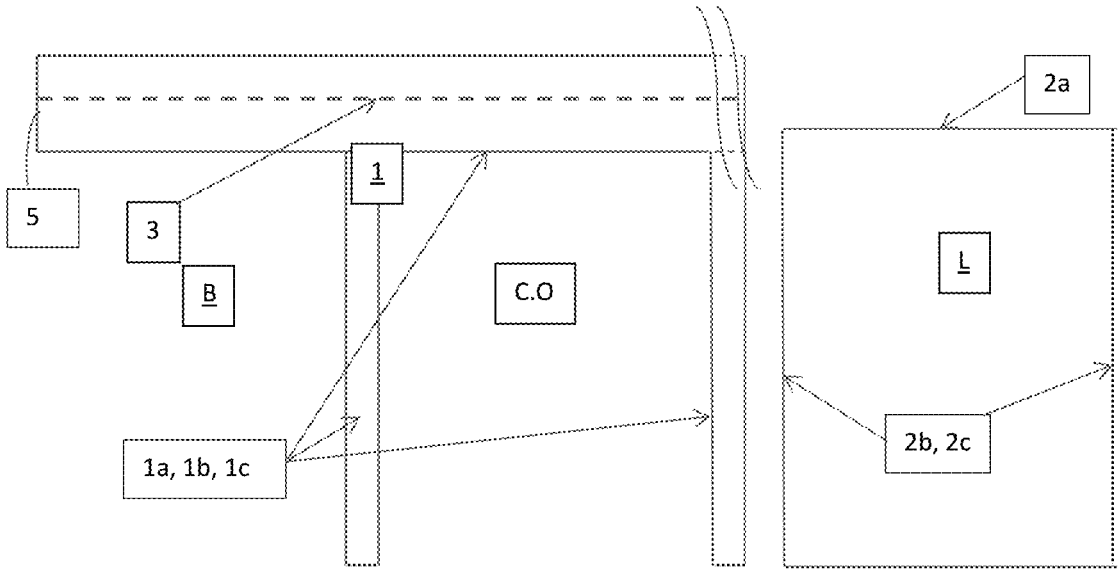
FIG. 1 illustrates the door assembly comprising a door frame assembly and door leaf.
Figure 1A:
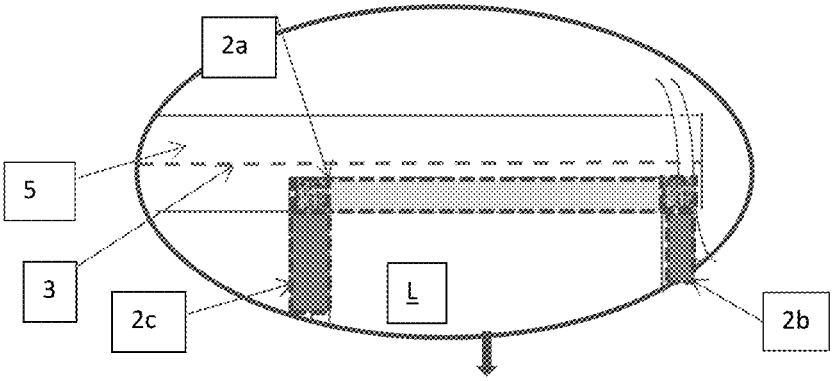
FIGS. 1A-1C illustrate the door leaf overlap with oversized overhead overlap member in closed, partially open and open position.
Figure 1B:
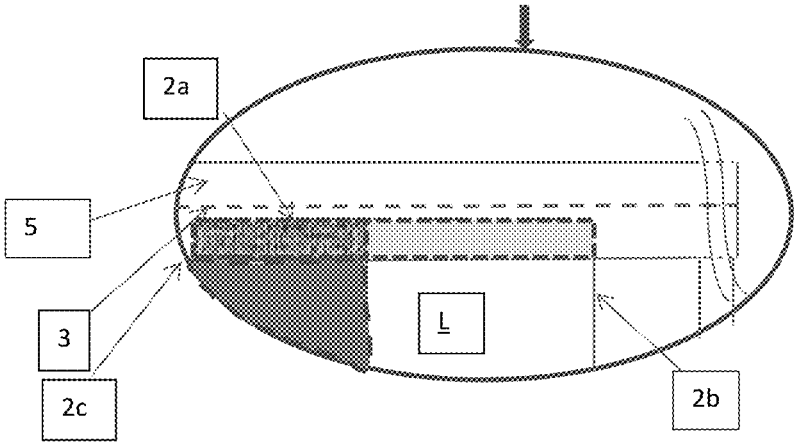
Figure 1C:
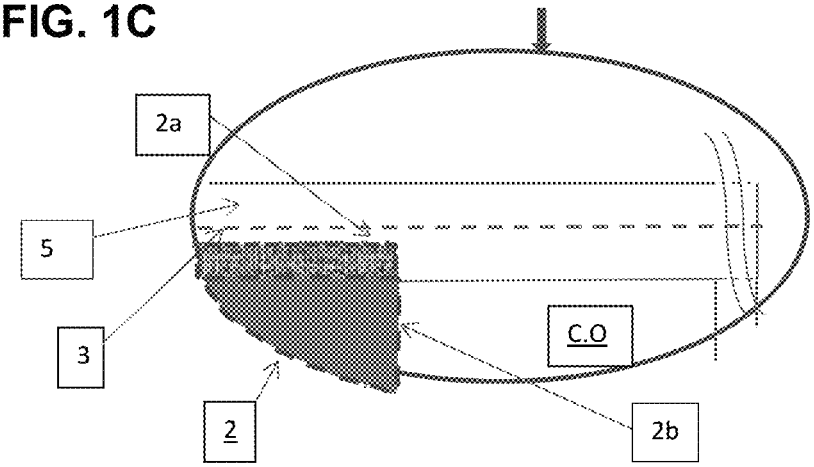

The door assembly of FIG. 1 comprises a slide-opening door assembly comprising a door frame assembly (1) having overlaps at headpiece (1*a*) and sidepiece and pocket opening (1*b*, 1*c*). The assembly is a single leaf assembly having headpiece (5) extending to one side of a side edge (1*b* or 1*c*). The door assembly also comprises door leaf (2) having a door leaf top edge (2*a*) and closing and pocket side edges (2*b*, 2*c*). Sliding assembly (3) is illustrated disposed along the headpiece (1*a*).

Door leaf (L) is configured to be hung or mounted in the door frame assembly (1) in sliding engagement (engagement coupling not shown) with sliding assembly (3). The door leaf (L) is slideable between a closed position in which the door leaf (2) occupies the doorway clear opening C.O (variously shown as aperture A) defined between overhead overlap portion of headpiece and side piece and pocket opening (1*a*, 1*b*, 1*c*) and restricts entry and exit, and an open position in which the door leaf occupies a pocket (P) to one side of side piece and pocket opening (1*b*, 1*c*).

The door frame assembly (1) is disposed and configured in manner to overlap the door leaf (L) at overhead overlap $O^O$ and at closing overlap $O^C$ and pocket overlap $O^P$ to both door side edges. Overlap secures the door assembly against ligature and against tampering by impact.

Figure 2:
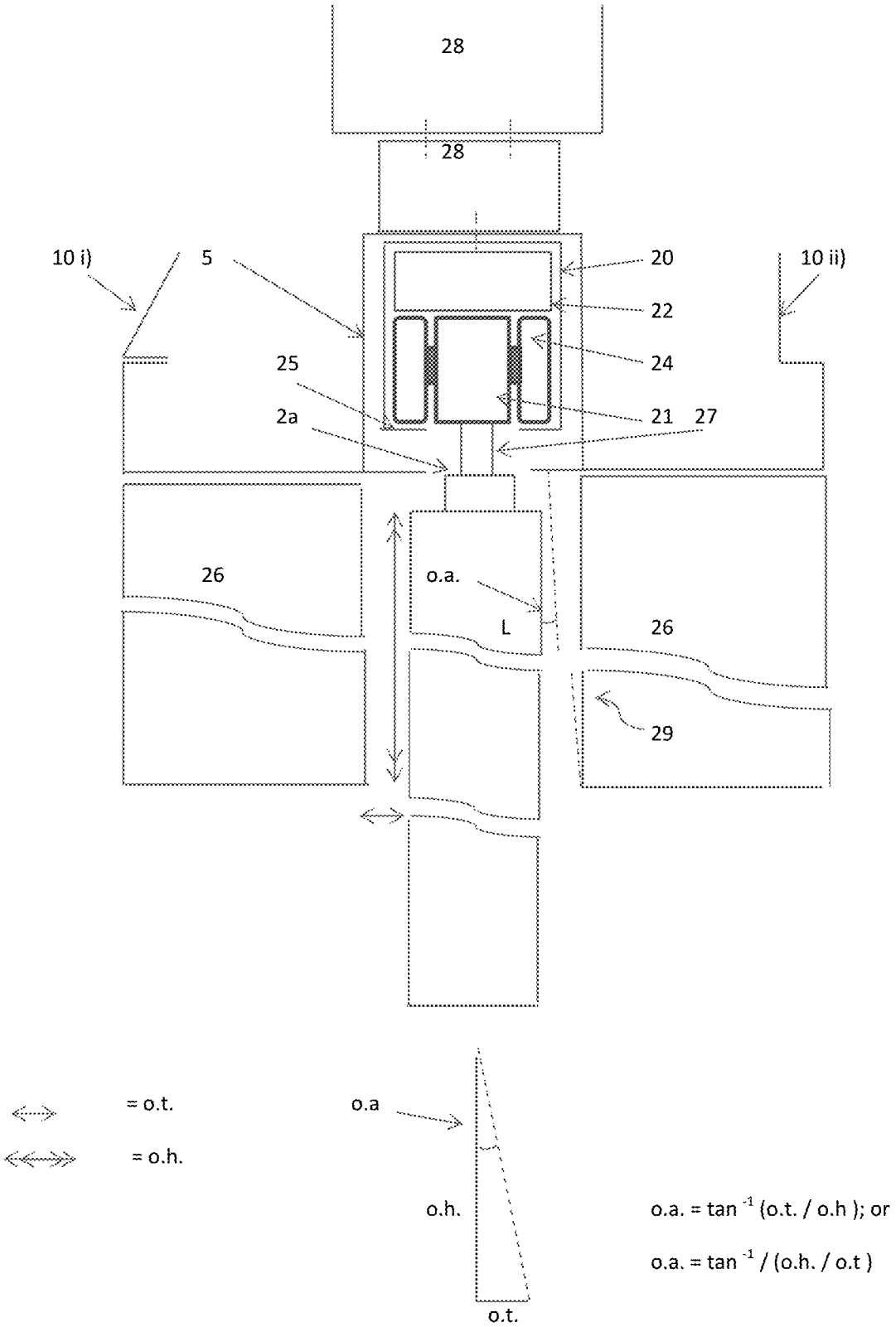
FIG. 2 illustrates the sliding assembly and relations of o.h., o.t. and o.a. in a door frame assembly.

FIG. 2 illustrates the sliding assembly (3) provided within headpiece (5) which is configured to be received within form work or stud work (28). Sliding assembly (3) comprises elongate profile member (20) adapted to receive overhead rolling mechanism (24). In the case of a powered sliding assembly, elongate profile member (20) also comprises drive means (22) such as electrical connections and solenoids disposed along its length. Rolling mechanism (24) includes wheels or rollers for sliding along elongate track portion (25) of elongate profile member (20), and optionally in the case of powered sliding assembly may incorporate electrical connections or magnets (21). An overhead overlap member (26) to either or both door leaf face (shown to both faces) is for example a top rail as known in the art. Coupling means (27) connects the rolling mechanism (24) and door leaf (L).

Overhead overlap member (26) overlaps door leaf (L) such that a straight line (29) drawn from the door leaf top edge (2*a*) to the lower face of overlap member (26) fails to penetrate the sliding assembly, for example is obstructed by elongate track portion (25). Straight line (29) subtends an angle o.a. to the door leaf (L) defined as $\tan^{-1}$ (o.t./o.h.) or $\tan^{-1}$/(o.t./o.h.) where o.t. is the overlap tolerance between door leaf (L) and overlap member (26) and o.h. is the height of the door leaf (L) overlapped by the overlap member (26).

Preferably in the first embodiment as hereinbefore defined the sliding assembly (3) is provided overhead of the position of the door leaf top edge and the height o.h. of the door leaf overlap, optionally in combination with the tolerance o.t. between door leaf (L) and overlap member (26) prevents access to the door leaf top edge (2*a*) and to the sliding assembly (3).

Figure 3A:
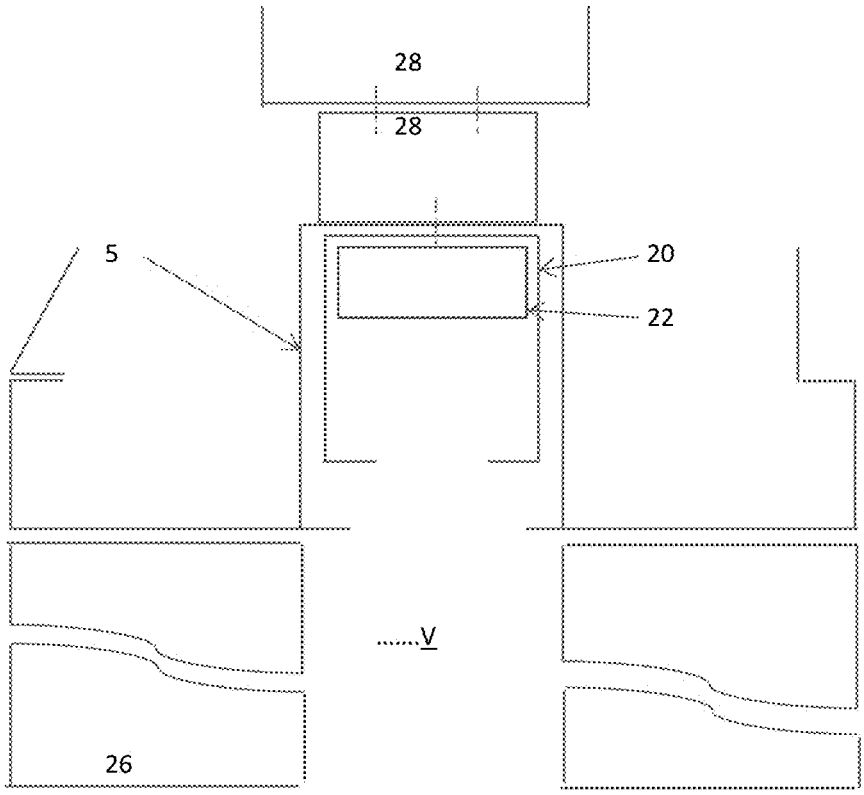
FIG. 3A illustrates the sliding assembly and overlap void.

FIG. 3A illustrates the arrangement of FIG. 2 with the door leaf (L) in open position and door leaf (L) position replaced by overhead overlap void $V^o$. Preferably in the first embodiment as hereinbefore defined the depth of the overlap member (26) prevents access without use of a suitable elongate rigid implement, to the door leaf top edge (2*a*) and to the sliding assembly (3).

Figure 3B:
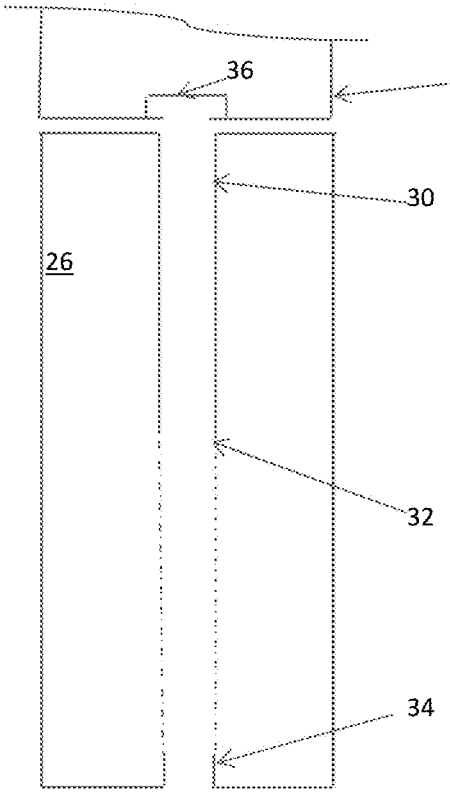
FIGS. 3B-3C illustrate the oversized overlap member or overhead panel comprising guide means for fixing or in an alternative embodiment comprising L-shaped flange and mating routered channel for mounting and securing suitably by recessed fixtures such as screws.

FIG. 3B illustrates a feature of the overhead overlap member (26) facilitating securing the overlap member (26) to headpiece (5). In particular a guide means (30) for a fixing element such as a screw is provided extending internally within the overhead overlap member from the top face towards (32) or to (34) the lower face thereof. The lower face of the overlap member (26) comprises presunk fixing hole (34) to receive a fixing element. The lower face of the headpiece (5) comprises a remote fixing element (36) such as an embedded or self tapping bolt which secures the end of a screw inserted upwardly from the lower face of the overlap element (26). A plurality of such guide means (30) are provided and a plurality of mating fixing apertures with remote fixing element (36).

Figure 3C:
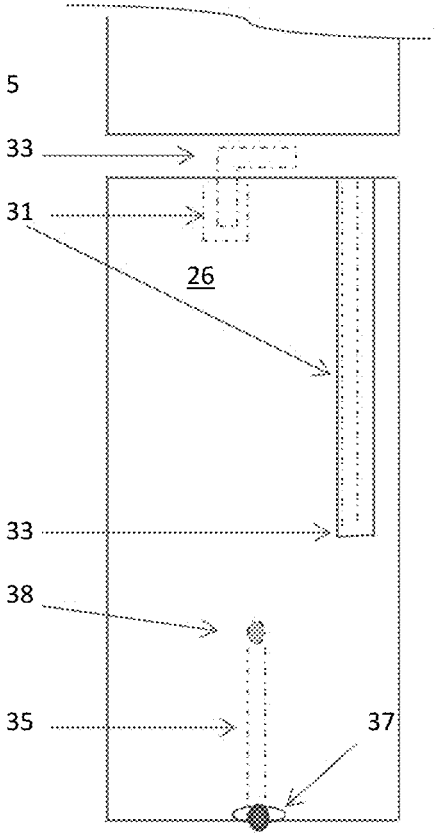

FIG. 3C shows an alternative embodiment comprising L-plate or section, or T-plate or section (33, dashes) secured to headpiece or sidepiece and seated in routered channel (31) in overhead overlap element (26) face adjoining the headpiece (5) or adjoining a sidepiece. Channels and L-plates may be positioned suitably in the thickness of the door leaf L. A further channel (35, dotted) internal to the overhead overlap element (26) accommodates locking bolt (38) which is activated by key (not shown) via aperture and optional faceplate (37) to advance the bolt (38) upwardly into a locking aperture (not shown) in the headpiece (5) or to advance the bolt (38) horizontally or upwardly inclined, into a locking aperture (not shown) in a side piece (not shown) to one side of the overhead overlap element (26).

Figure 4:
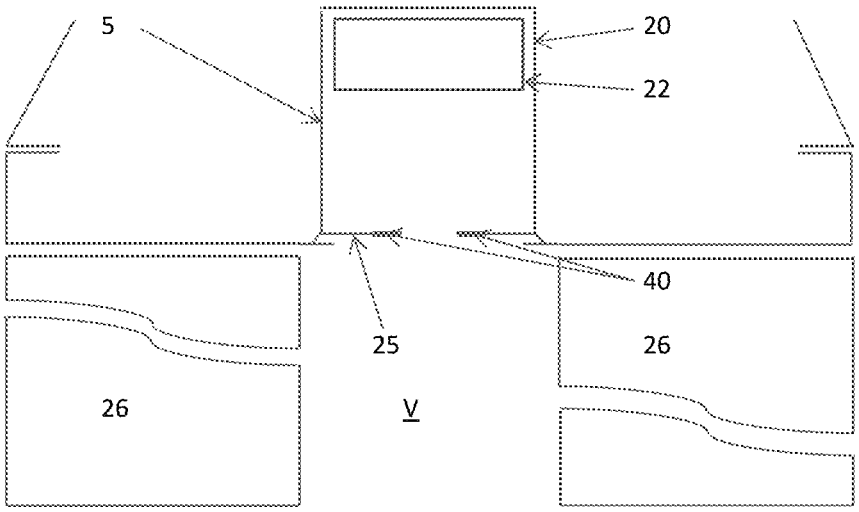
FIGS. 4 and 5 illustrate the headpiece including shielding elements with the door leaf in open and closed position.
Figure 5:
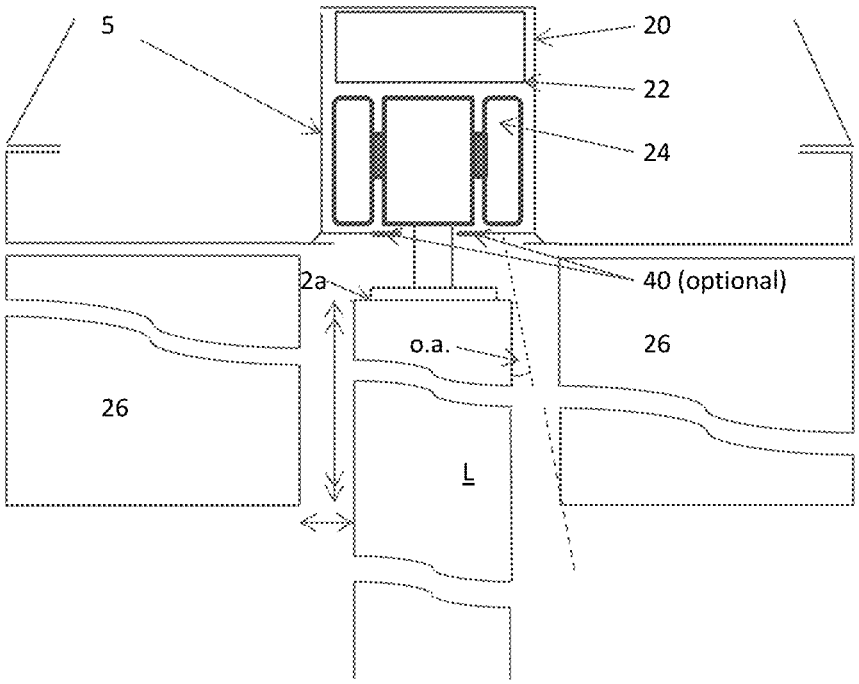

FIGS. 4 and 5 illustrate the assembly of FIGS. 3A and 2 wherein, where not indicated, parts have the identity indicated in FIGS. 3A and 2, and wherein elongate track (25) comprises one or more shielding elements (40). Shielding elements (40) serve to further obstruct access to sliding assembly (3) with door leaf (L) in open or closed position. Line (29) is obstructed for a broader range of ratios of o.h. to o.t. Shielding elements may be rigid or resiliently deformable flanges providing an aperture for passage of coupling means (27).

Figure 6:
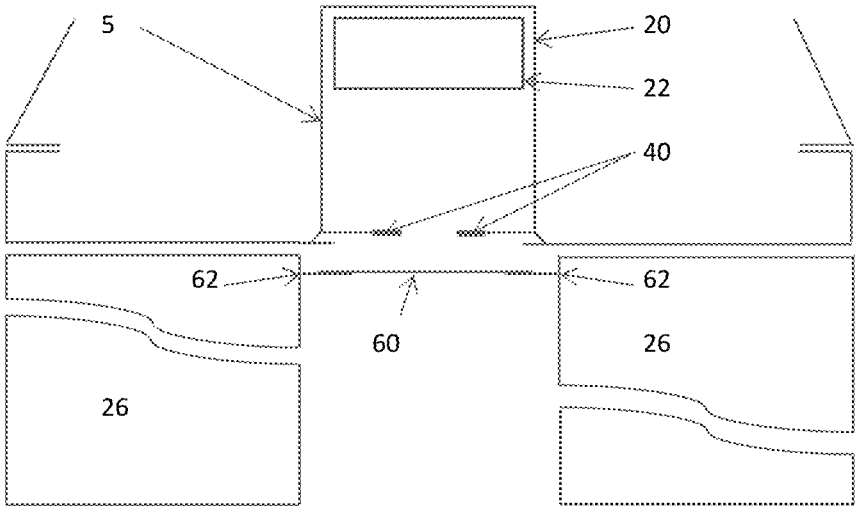
FIG. 6 illustrates the headpiece including dynamic shutter means.
Figure 7:
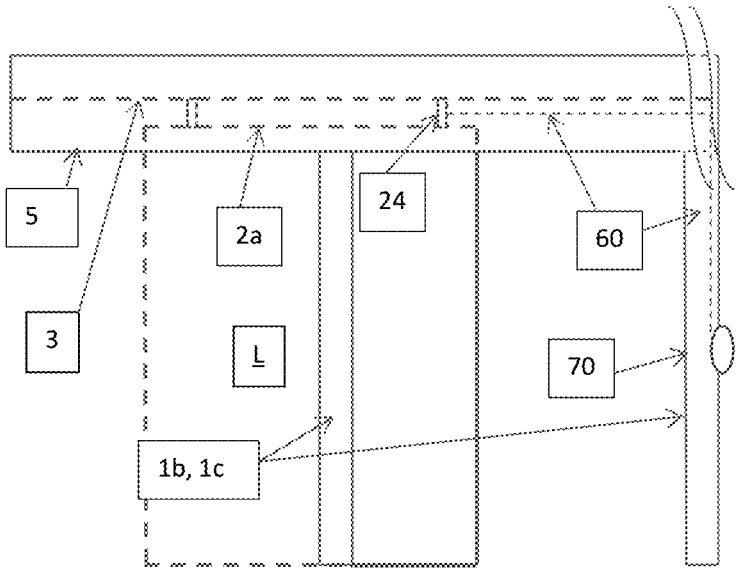
FIG. 7 illustrates the door assembly including headpiece including dynamic shutter means of FIG. 6, with shutter means retracting into side piece.

FIGS. 6 and 7 illustrate a variation of shielding means comprising dynamic shutter means (60) optionally engaging with supports or flanges (62) optionally in sealing engagement. Shutter means (60) are engaged by coupling means (27) so as to be drawn along the overlap void V with the opening of the door leaf (L). Side edge (1*b*) receives the shutter means (60) with the closing of the door leaf (L). Biasing means (70) located within the side edge (1*b*) or the support structure for door assembly engages the shutter means (60) and retracts the shutter means (60) from overlap void V with the closing of the door leaf.

Figure 8A:
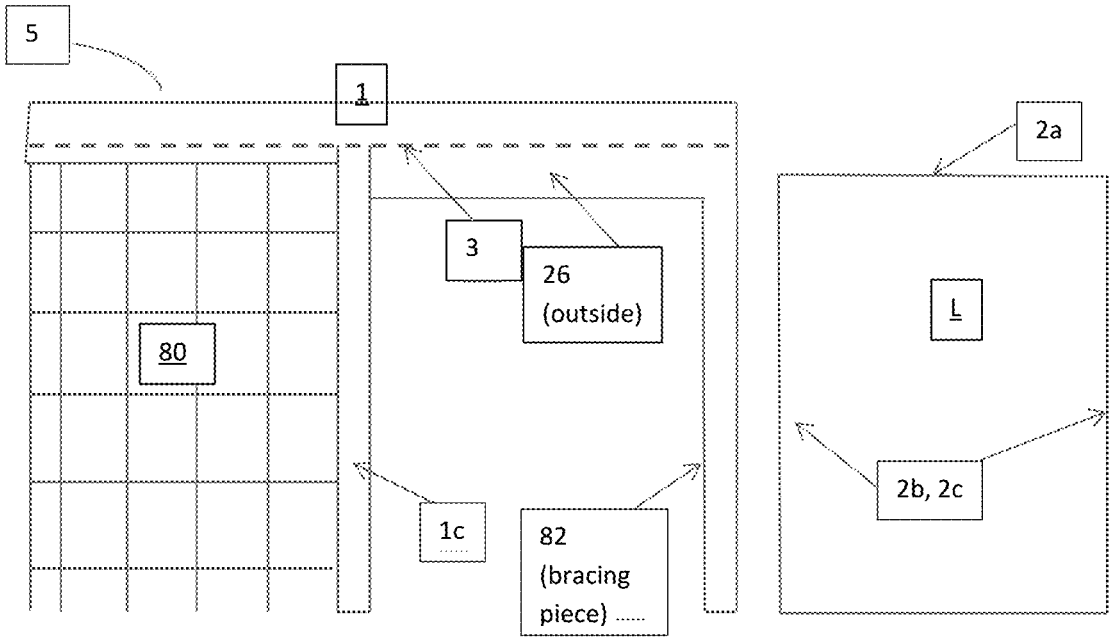
FIGS. 8A-8C illustrate the pocket door assembly provided in multiple parts.
Figure 8B:
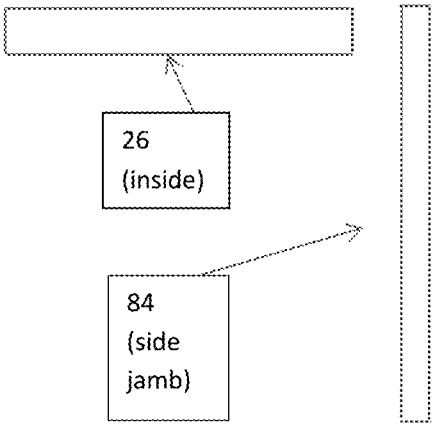
Figure 8C:
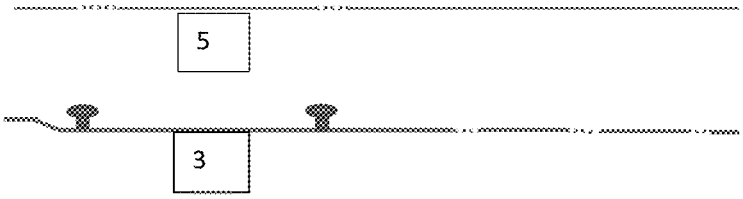

FIG. 8A-C illustrates a pocket (80) door assembly (1, L) in multiple parts. The reinforced door assembly described herein may conveniently be provided non assembled. However there remains a need to provide in manner to be able to assemble in situ and yet achieve overlap tolerances as herein described. Illustrated in FIG. 8B, preferably, the at least one overhead overlap element (26) is provided separately to the headpiece (5) illustrated in FIG. 8A. Separately provided overhead overlap element (26) is conveniently secured to the headpiece (5) after installing the door leaf (2) in situ. Preferably overhead overlap element (26) is a hollow element constructed of steel as hereinbefore defined. Securing to the headpiece (5) requires locating a fixing means across the hollow steel element, in this case via a fixing aperture in a face of the overlap element defining the opening aperture, upwardly through an opposing face to seat into a face of the headpiece. Location is unguided and inaccurate. In a particular advantage the overlap element comprises a guide channel between opposing faces to receive a fixing means as previously described. Illustrated in FIG. 8B, preferably at least one closing jamb (84) is provided separately to the sidepiece (82) illustrated in FIG. 8A. By this means door leaf (L) can be located in position in the doorway C.O. aperture A parallel aligned to the face of the frame assembly, coupled to the sliding assembly (3) and overlap elements (26, 84) secured in place. By this means a pocket door assembly with overlap tolerances o.t as herein defined is provided. FIG. 8C illustrates mounting means for securing the track within the pocket by a push fit, sliding fit and/or drop fit mechanism. For example one or a plurality of mushroom heads projecting upwardly from the track are adapted to be received in a corresponding number of keyhole slots provided in the headpiece, in the door assembly (1) of FIG. 8A.

Figure 9:
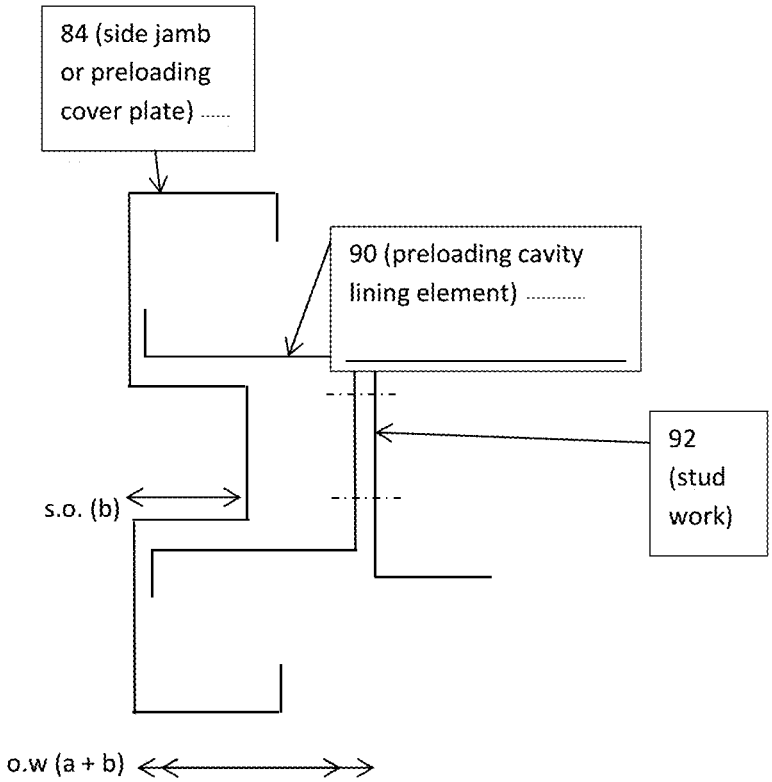
FIG. 9 illustrates the separate closing jamb for a pocket door assembly of FIG. 8.

FIG. 9 illustrates the side piece as herein defined. A side overlap is for example a pocket jamb or a closing side jamb (84) as known in the art. Closing side jamb (84) is received in preloading cavity lining element (90) which is received in form work or stud work (92). Preloading cavity lining element (90) provides preloading cavity lining width which is greater than closing side jamb width. Preloading cavity lining depth is greater than closing jamb depth. Coupling door leaf (L), and sliding into an open position, serves to vacate a preloading cavity defined by the preloading cavity lining element to receive closing jamb (84) which is located within the preloading cavity and secured in position. By this means a pocket door assembly with overlap tolerances o.t and side overlaps as hereinbefore defined is provided. Significantly this enables loading door leaf at side edge 1*b* in preloading cavity with door leaf out of alignment and swinging into alignment in manner to slide into pocket P, with subsequent adjustment of side overlap tolerances by means of closing jamb.

Figure 10A:
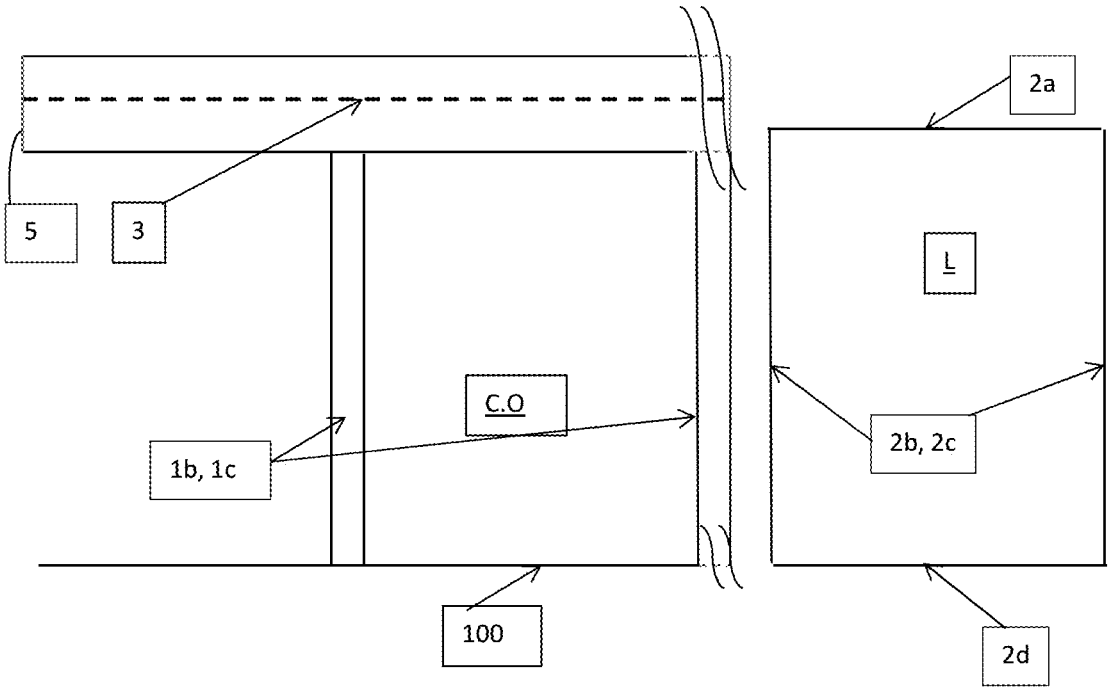
FIGS. 10A-10E illustrate the door assembly including bottom piece having rolling gear, static sliding element or wiper seal.
Figure 10B:
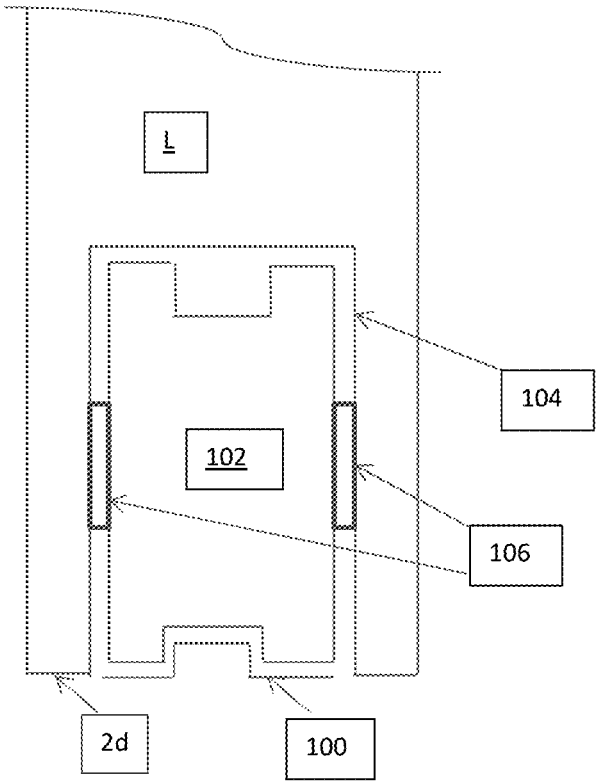
Figure 10C:
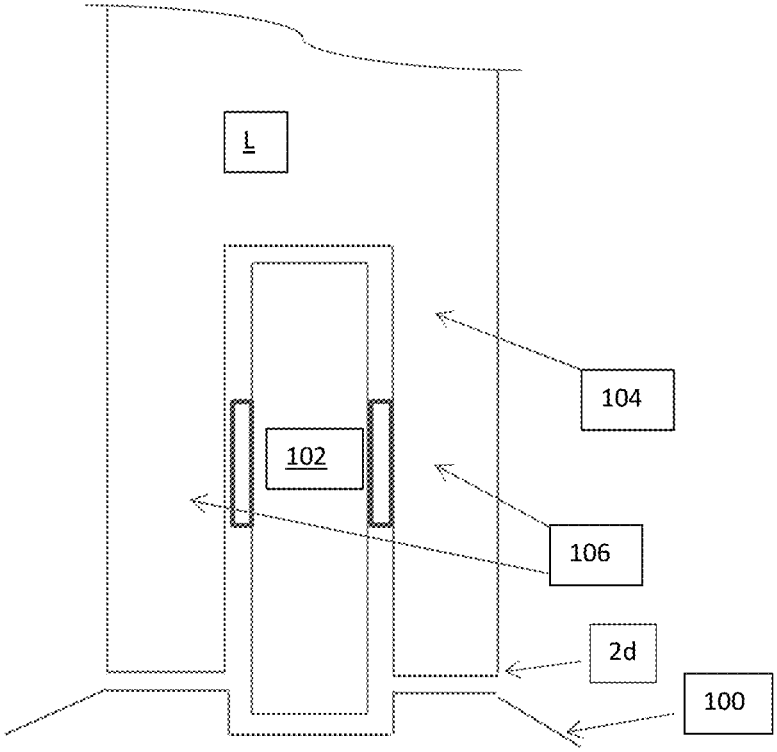
Figure 10D:
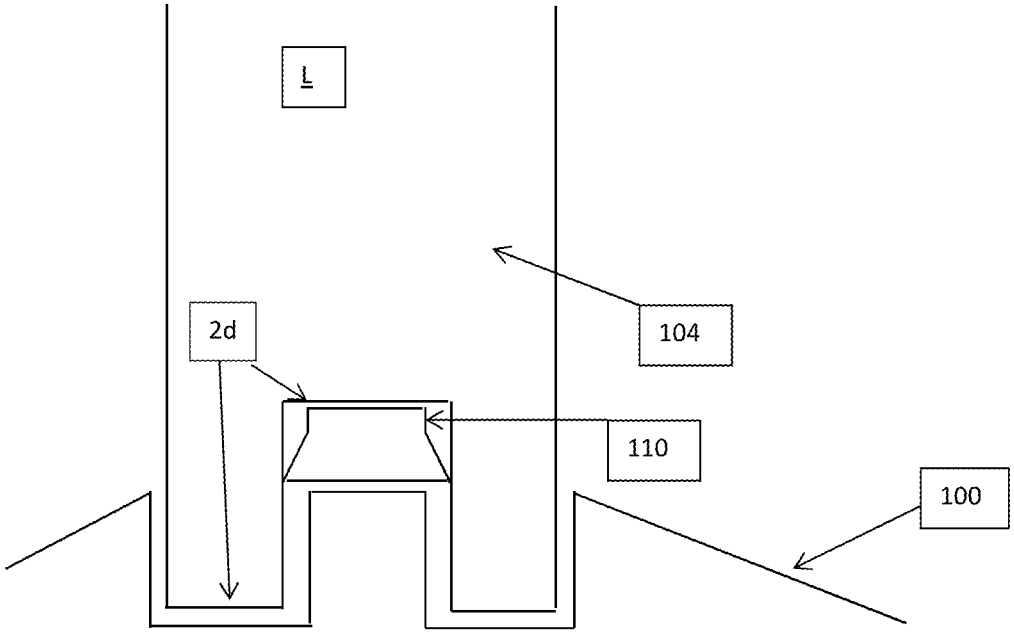
Figure 10E:
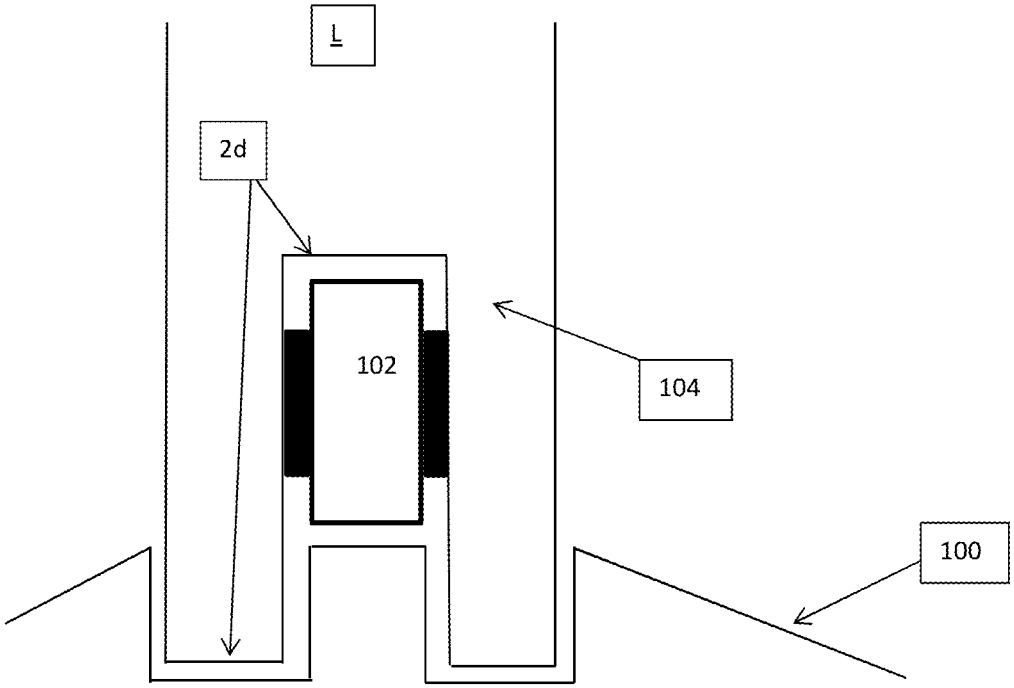

FIG. 10A, FIG. 10B, FIG. 10C and FIG. 10E illustrate the door assembly having bottom piece (100) disposable across the door frame assembly and slideably engageable with the door leaf lower edge (2*d*) by means of lower static sliding element (not shown) or rolling mechanism (102, 106) suitably received within aperture (104) of the door leaf lower edge (2*d*). The door assembly comprising bottom rolling mechanism (102, 106) of FIG. 10B, FIG. 10C, and FIG. 10E is particularly useful when providing in reinforced door assembly whereby the weight of the door leaf merits additional means for support with sliding coupling means, in particular in combination with an overhead static sliding assembly such as illustrated in FIGS. 13 to 19.

FIG. 10D illustrates an arrangement with wiper seal (110) angled towards closing side edge. Wiper seal (110) is disposed at door leaf (L) bottom edge (2*d*) at closing side edge (2*b*) thereof to lightly contact bottom piece (100) and so as to push aside obstacles as the door leaf L advances. Should an obstacle remain in the path of the advancing door leaf L and impede wiper seal (110), pressure exerted on wiper seal (110) increases pressure of wiper seal (110) contact to bottom piece (100), thereby preventing entrainment of such obstacle. Static sliding or rolling mechanism (102, not shown), if present, is disposed rearwardly of wiper seal (110), having regard to the direction of closing of door leaf (L), as illustrated in FIG. 10E in the form of rolling mechanism (102), or alternatively in the form of static sliding element (not shown) such as a low friction surface of door leaf (L) bottom edge (2*d*) and/or low friction surface of bottom track recesses and/or flange.

Figure 11:
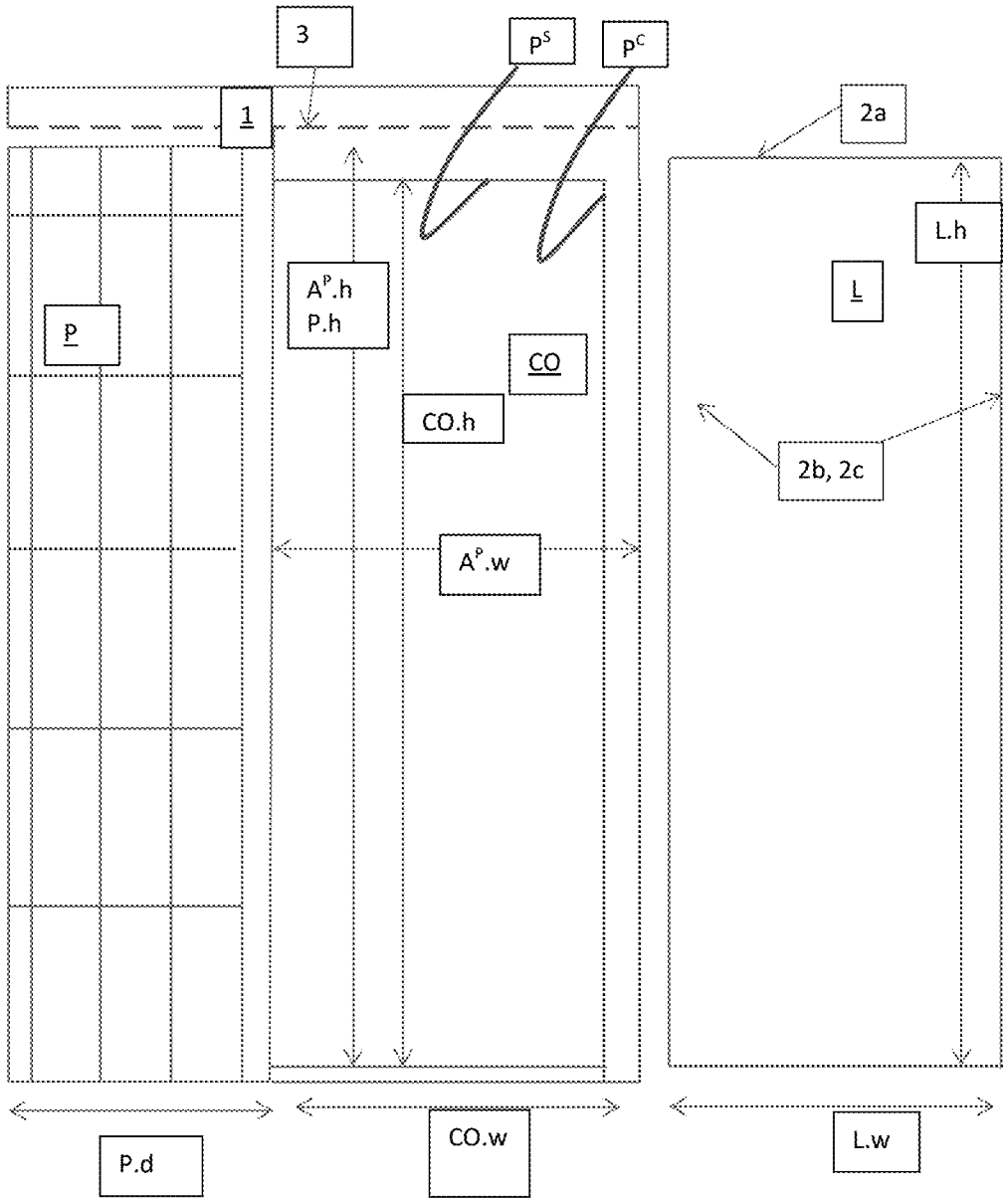
FIGS. 11 and 11A illustrate the assembly as defined with reference to clear opening, preload opening and preload aperture, having foreshortened pocket depth, for delivery of door assembly rotated onto its side.
Figure 11A:
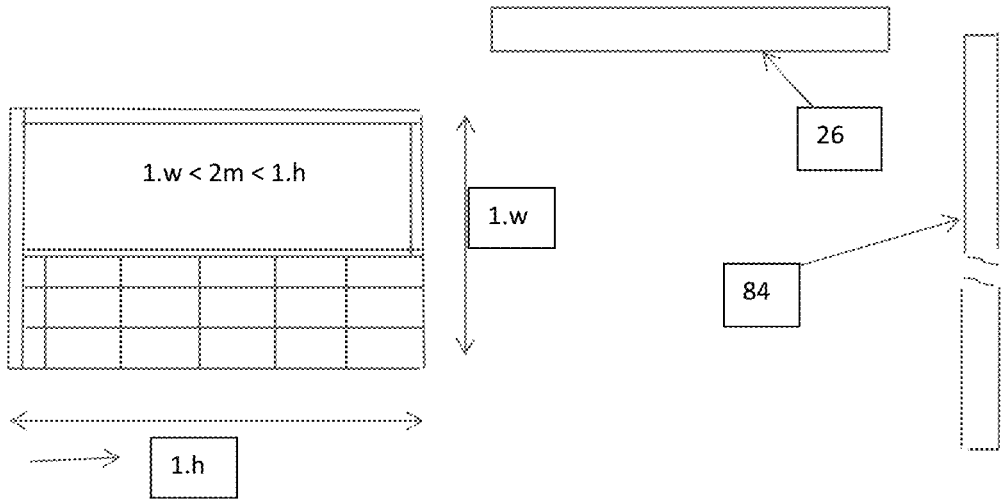

FIG. 11 illustrates the door assembly with foreshortened pocket depth, suitable for rotating onto a side edge for delivery, with overhead overlap element 26 and side jamb 84 as separate components. $A^P$h and $A^P$w denote the height and width of a preloading aperture, with overhead overlap element 26 and side jamb absent 84, into which door leaf L is loaded thereafter securing overhead overlap element 26 and side jamb 84 in place. l.h and l.w denote overall height and width of frame assembly.

Figure 12:
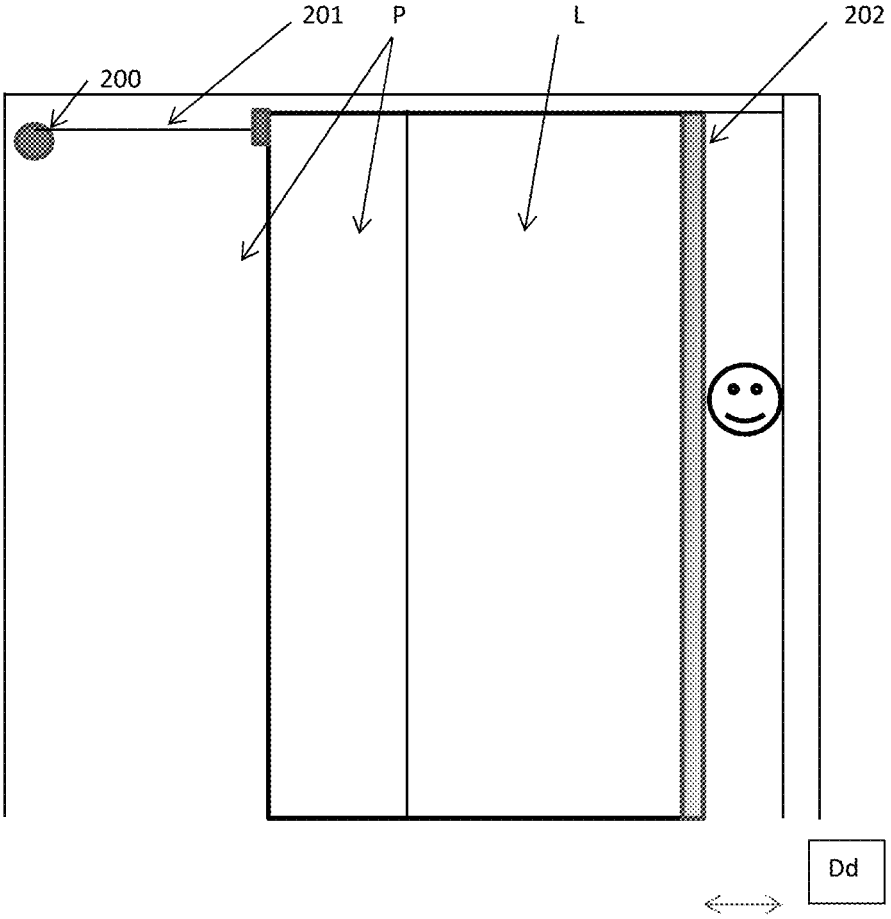
FIG. 12 illustrates the door assembly having damper arrangements.
Figure 13:
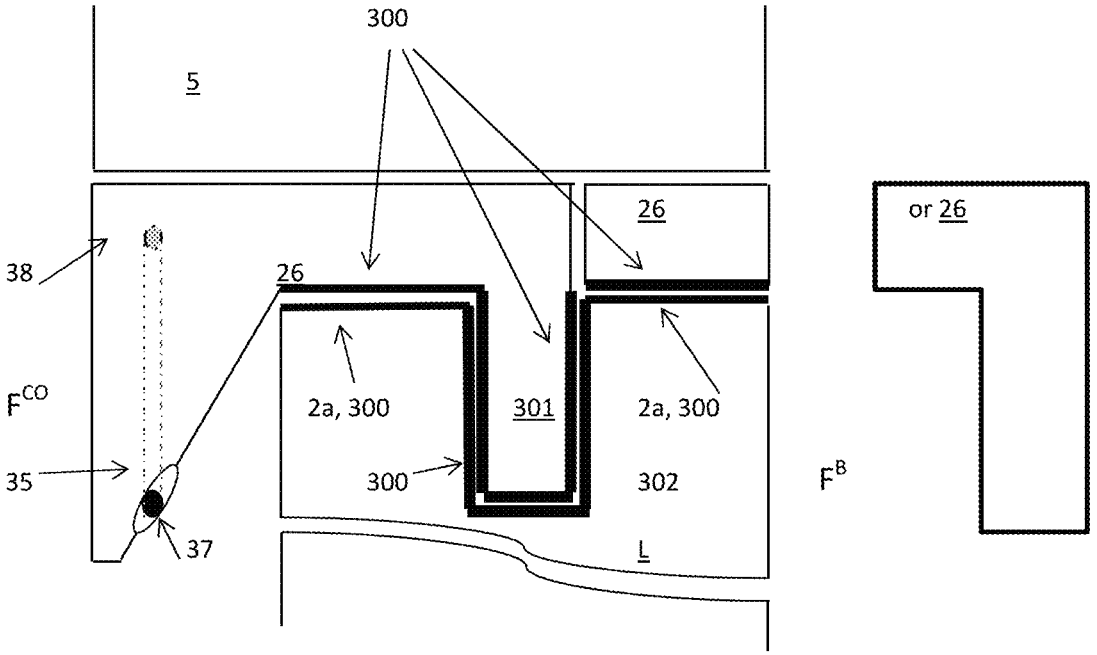
FIGS. 13 to 20 illustrate the door assembly having variants of overhead sliding assembly providing overhead overlap element.
Figure 14:
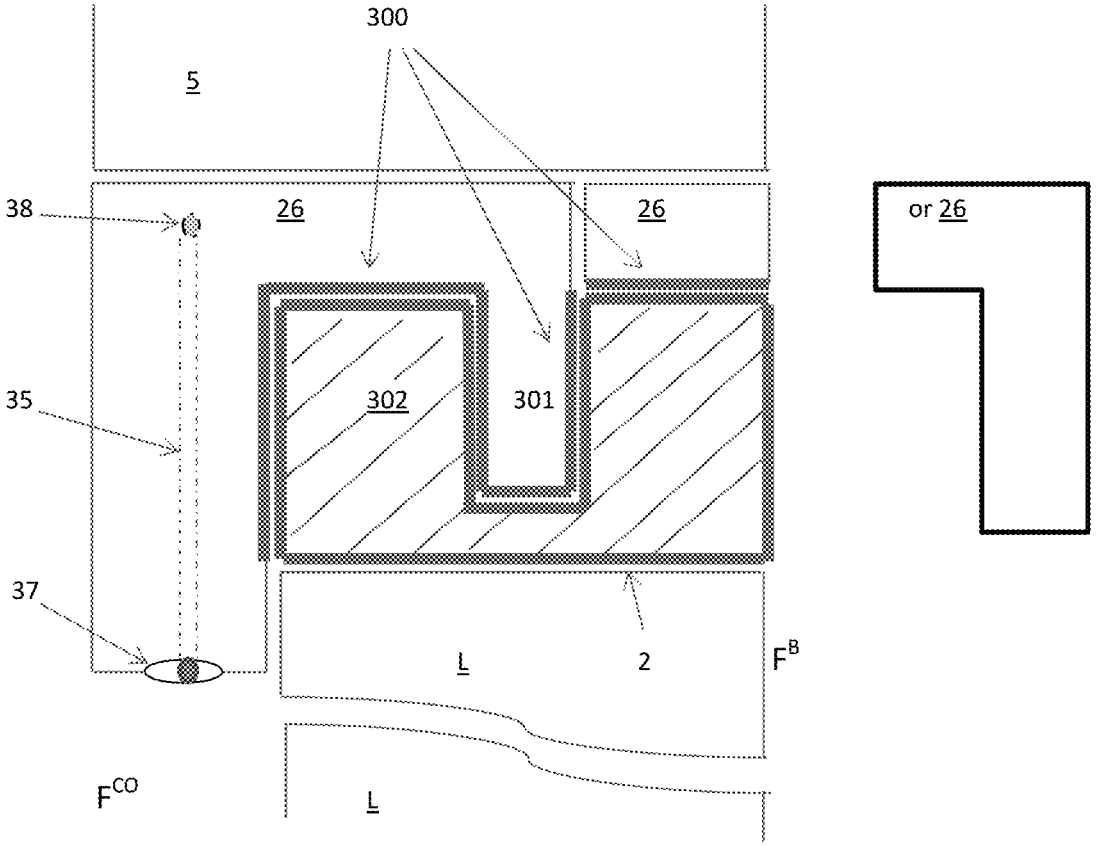
Figure 15:
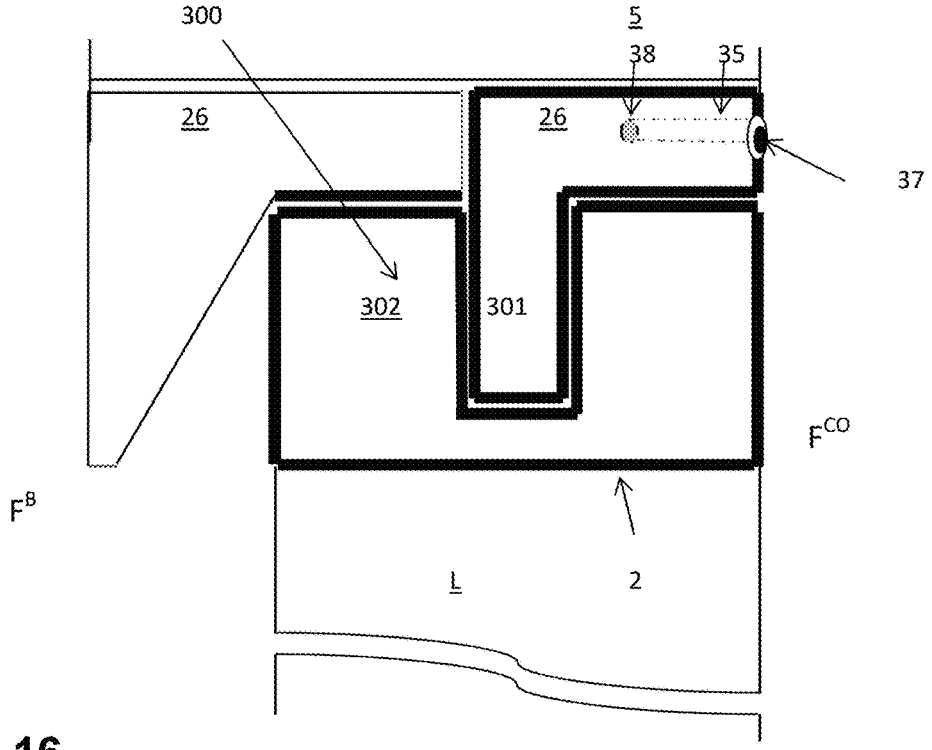
Figure 16:
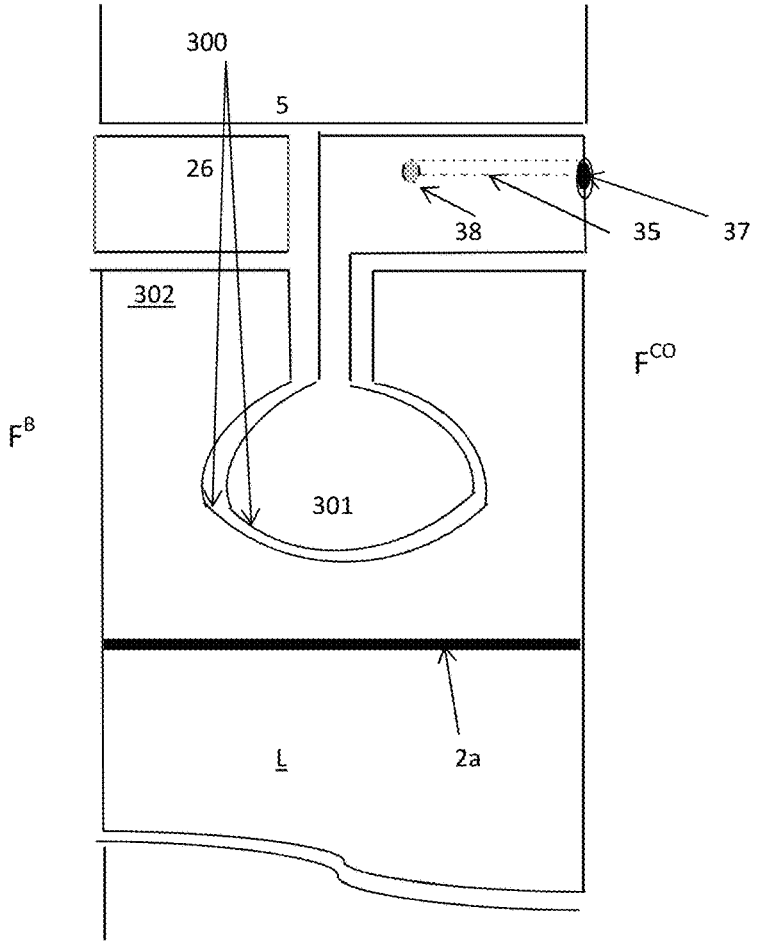
Figure 17:
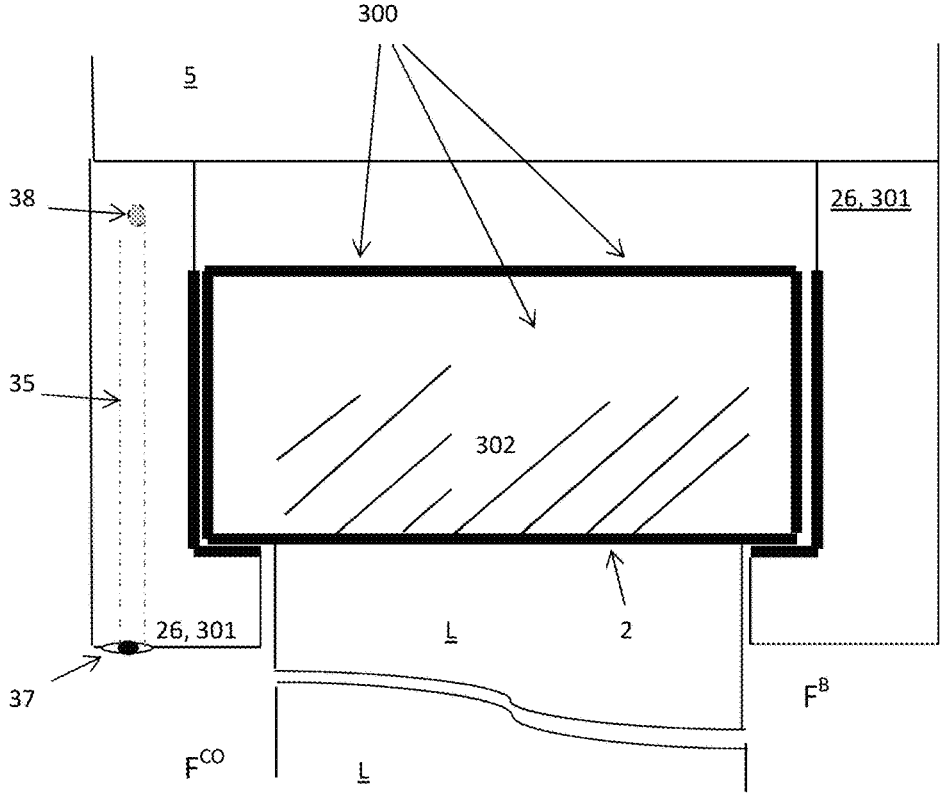

FIG. 12 illustrates damping means as described, including inertia reel closing damper 200, having tape 201 attached to the pocket side edge of door leaf L and providing damping distance Dd in excess of 15 cm or 20 cm. Door leaf closing side edge comprises resiliently deformable or compressible buffer 202. Inertia reel damper 201 ensures that an individual cannot be struck with force by the closing door leaf, whilst damper 202 ensures a soft impact at any body part or object struck by door leaf.

Figure 18:
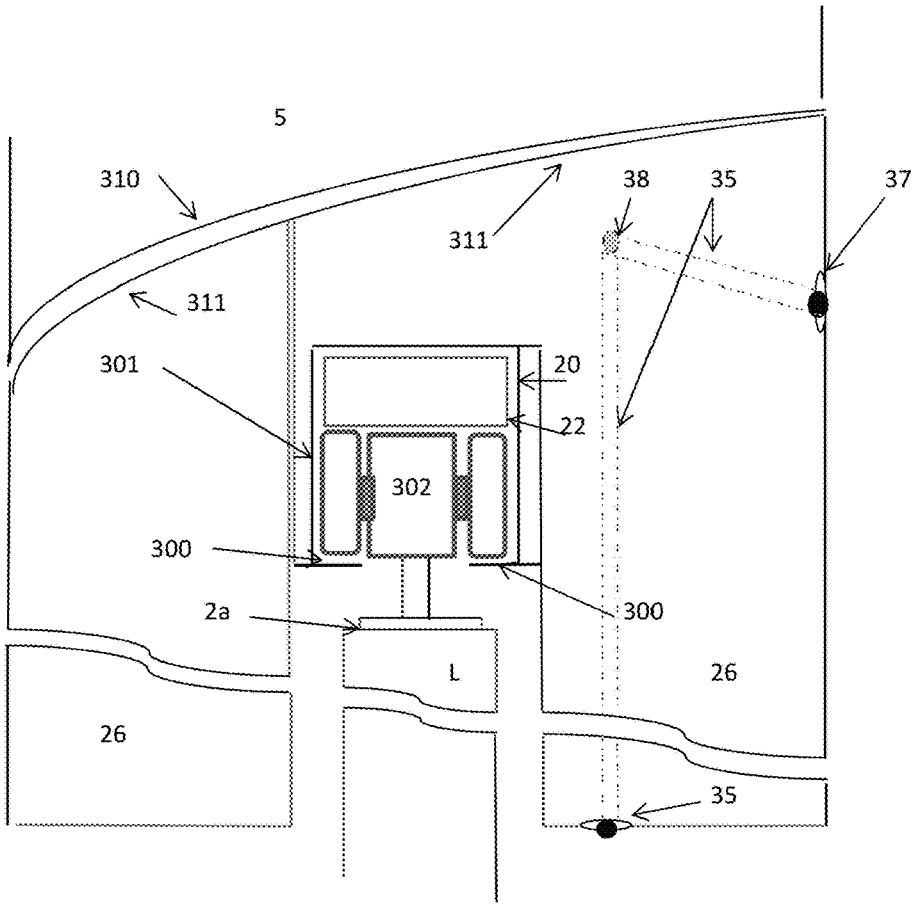
Figure 19:
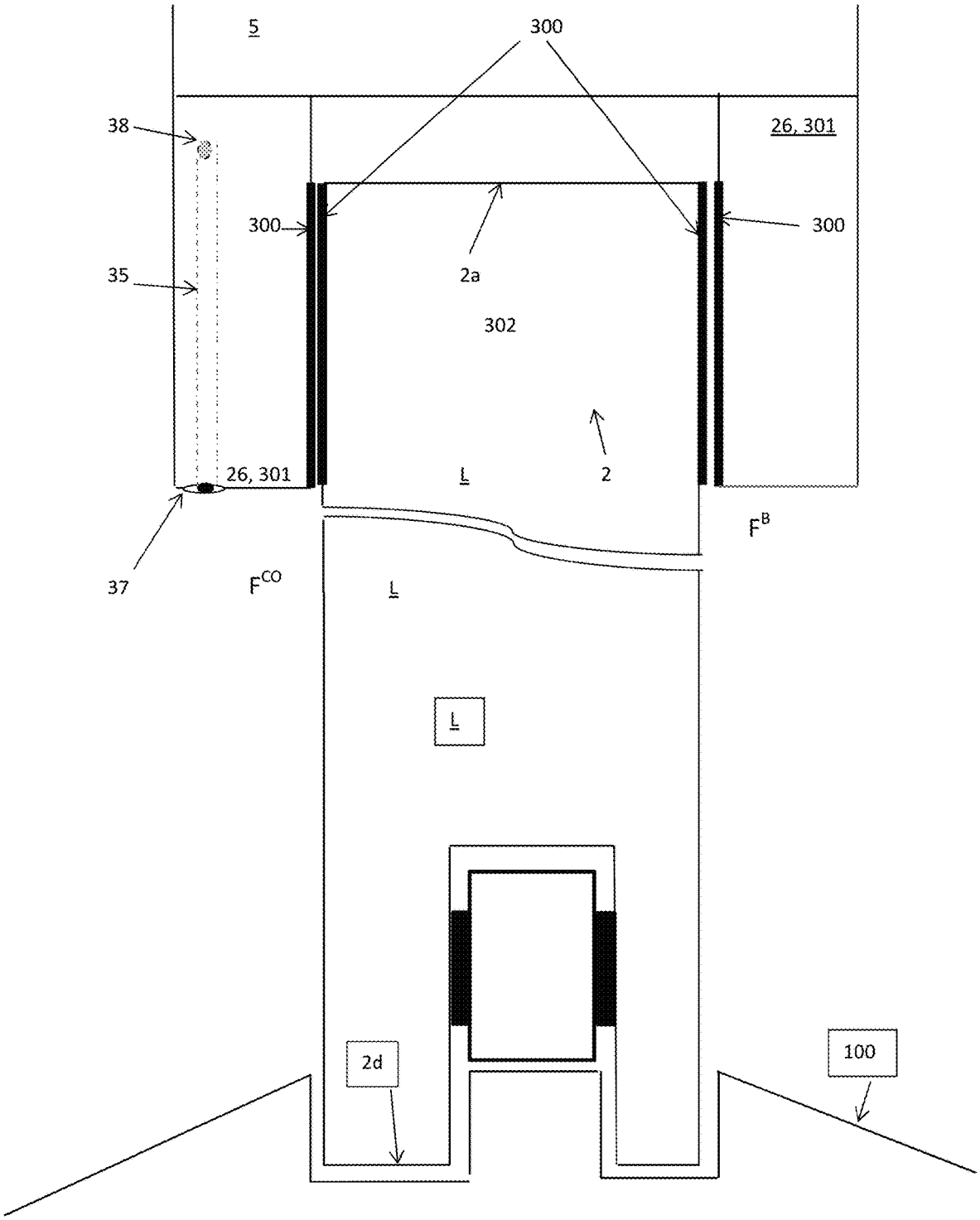
Figure 20:
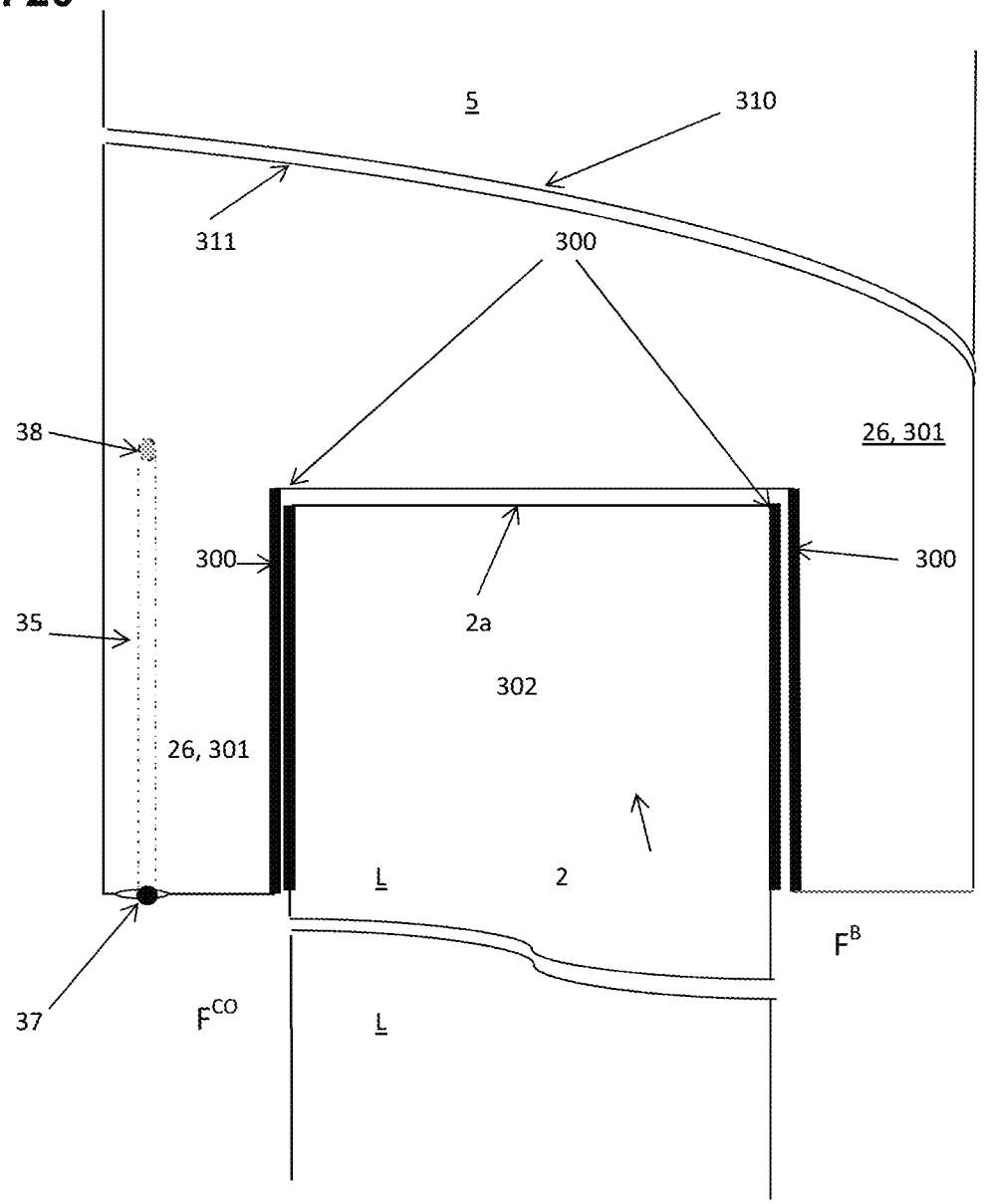

FIGS. 13 to 20 illustrate overhead overlap element comprising integral overhead sliding assembly track releasably mounted to the frame assembly. Parts have the same meaning as in foregoing figures. In this case an overhead overlap element or either or both of two overhead overlap elements (26) include a low friction static sliding surface (300) disposed as a covering or as a part of sliding track (301) at the overhead overlap element (26). Door leaf top edge (2*a*) comprises in similar manner a low friction static sliding surface (300) disposed as a covering or as a part of sliding element (302) disposed at or forming the door leaf top edge (2*a*). An overlap may be provided to either or both faces, in any arrangement or combination of arrangements illustrated. Overhead overlap element comprising static sliding track (302) is releasably mounted to a clear opening face $F^{CO}$, located opposite to a barricade risk face $F^{CO}$. In FIGS. 18 and 20 overlap element (26) and headpiece (5) are illustrated having radiused face (311, 310) to facilitate door leaf (L) removal by tilt at bottom edge of door leaf (not shown). Releasable mounting means are illustrated at the clear opening face $F^{CO}$ comprising channel (35, dotted) internal to the overhead overlap element (26) for securing to clear opening face $F^{CO}$, for accommodating locking bolt (38) which is activated by key (not shown) via aperture and optional faceplate (37) to advance the bolt (38) upwardly into a locking aperture (not shown) in the headpiece (5) or to advance the bolt (38) horizontally or upwardly inclined, into a locking aperture (not shown) in a side piece (not shown) to one side of the overhead overlap element (26). In FIG. 18 is illustrated both configurations of channel (35) and aperture and optional faceplate (38).

Although a few preferred embodiments have been shown and described, it will be appreciated by those skilled in the art that various changes and modifications might be made without departing from the scope of the invention, as defined in the appended claims.

Attention is directed to all papers and documents which are filed concurrently with or previous to this specification in connection with this application and which are open to public inspection with this specification, and the contents of all such papers and documents are incorporated herein by reference.

All of the features disclosed in this specification (including any accompanying claims, abstract and drawings), and/or all of the steps of any method or process so disclosed, may be combined in any combination, except combinations where at least some of such features and/or steps are mutually exclusive.

Each feature disclosed in this specification (including any accompanying claims, abstract and drawings) may be replaced by alternative features serving the same, equivalent or similar purpose, unless expressly stated otherwise. Thus, unless expressly stated otherwise, each feature disclosed is one example only of a generic series of equivalent or similar features.

The invention is not restricted to the details of the foregoing embodiment(s). The invention extends to any novel one, or any novel combination, of the features disclosed in this specification (including any accompanying claims, abstract and drawings), or to any novel one, or any novel combination, of the steps of any method or process so disclosed.

The invention claimed is:

1. An anti-ligature pocket slide opening door assembly for use in a building which houses an individual at a risk of intentional self-harming, comprising: a door frame assembly which comprises a headpiece, two sidepieces, and a pocket;

a door leaf which comprises a top edge, a closing side edge, a pocket side edge and a bottom edge; and a sliding assembly for slideable translation of the door leaf in relation to the door frame assembly between a closed position and an open position, wherein the door frame assembly provides, with the door leaf in the closed position: an overhead overlap (0°) with the door leaf at the top edge provided by at least one overhead overlap element to the door frame assembly, provided separate from the headpiece for securing by an anti-tamper and anti-ligature fixings, wherein the overhead overlap is characterised by an overhead overlap height o.h being a height of the door leaf overlapped by the at least one overhead overlap element;

a closing side overlap (Oc) with the door leaf at the closing side edge; and a pocket side overlap (Op) with the door leaf at the pocket side edge, wherein Op is in a range from 1.2 cm to 5 cm;

wherein the sliding assembly is an electromagnetic drive sliding assembly having components disposed in relation to the electromagnetic drive sliding assembly, and configured to decelerate the door leaf approaching the closed position or the open position or to absorb impact of the door leaf on the door frame assembly, at a moment of reaching the closed position or the open position; and wherein: the door leaf is oversized, and the door frame assembly including the pocket is correspondingly oversized, and the oversized door leaf has a height D.h. in a range from 220 cm up to 300 cm, the overhead overlap element is oversized, and the oversized overhead overlap element has an oversized overhead overlap height o.h in a range from 5 cm to 40 cm, and the sliding assembly is disposed within the headpiece of the oversized door frame assembly at a top portion of, or overhead, the oversized overhead overlap element, which prevents access to the sliding assembly for a ligature purpose, with the oversized door leaf in the closed position; and wherein:

the oversized door frame assembly, with the oversized door leaf in the open position or in a partially open position, provides an oversized overhead overlap void which has an overlap void height ov.h in a range from 7 cm to 54 cm being a sum of o.h and a vertical separation between the top edge of the oversized door leaf and the sliding assembly, which prevents access to the sliding assembly for a ligature purpose, with the oversized door leaf in the open position or in the partially open position.

2. The anti ligature pocket slide opening door assembly according to claim 1, wherein the sliding assembly comprises:

one or more elongate track elements mountable to the door frame assembly, and one or more sliding elements couplingly engageable with the door leaf for a sliding engagement of the door frame assembly and the door leaf, wherein the one or more elongate track elements are disposed in a continuous or intermittent fashion along the headpiece of the door frame assembly and electromagnetic components are disposed along the length of the one or more elongate track elements;

wherein a portion of the sliding assembly is configured for mounting in the pocket and is a removable sliding assembly track element comprising a mating component at a pocket end thereof for mounting to a corresponding mating component provided internally within the pocket by at least one of a push fit mechanism, a sliding fit mechanism and a drop fit mechanism and a combination thereof.

3. The anti ligature pocket slide opening door assembly according to claim 1, comprising a bottom piece of the door frame assembly disposed across the door frame assembly and slideably engageable with a door leaf lower edge, wherein the bottom piece of the door frame assembly comprises one or more elongate track elements of a bottom sliding assembly, and the lower edge of the door leaf provides one or more sliding elements for a sliding engagement of the door frame assembly and the door leaf, and wherein the one or more sliding elements comprise one or more-static sliding or rolling surfaces, wherein the bottom piece is provided integral with the door frame assembly, and wherein the door assembly is provided in two components, being the door leaf and the door frame assembly, including the pocket to receive the door leaf, wherein the at least one overhead overlap element is provided as an additional assembly components, and wherein the door frame assembly is packaged for a delivery rotated onto a side of the door frame assembly with the pocket or the sidepiece uppermost; wherein the bottom piece, provided integral with the door frame assembly, is connected in an anti-ligature and anti-tamper manner at the sidepieces, and provides support to the sidepieces distal from the headpiece, against a misalignment, with the door frame assembly rotated onto a side with the pocket or the sidepiece uppermost, and against a loading to the headpiece in a direction in which it is not intended to be load bearing in use.

4. The anti ligature pocket slide opening door assembly according to claim 1, comprising one or more seals between the door leaf and the door frame assembly selected from:

an elongate seal mounted to one of a door leaf pocket side edge and a pocket sidepiece to the door frame assembly and extending outwardly to contact the other of the pocket sidepiece to the door frame assembly and the door leaf pocket side edge, and which is a one part seal, or is a two part seal configured to engage with a corresponding seal mounted on the other of the pocket sidepiece and the pocket side edge;

a wiper seal mounted on either of the door leaf and the door frame assembly and comprising an angled deformable blade configured and disposed to loosely contact the other of the door leaf and the door frame assembly at an edge or a face thereof;

and a wiper seal provided at the bottom edge of the door leaf to loosely contact a bottom piece to the door frame assembly;

wherein the one or more seals is angled outwardly towards a closing sidepiece of the door frame assembly or towards the closing side edge.

5. The anti ligature pocket slide opening door assembly according to claim 1, wherein the pocket comprises a pocket framework and a lining facing and sealing the pocket framework wherein the lining is selected from a polymer, a metal, an antibacterial polymer, an antibacterial metal, an antibacterial coated polymer, an antibacterial coated metal or a combination thereof and wherein the lining is removable, to be withdrawn for cleaning purpose and reinserted or the lining comprises smooth walls which facilitate effective cleaning in situ, from outside the pocket.

6. The anti ligature pocket slide opening door assembly according to claim 1, wherein the at least one overhead overlap element comprises a recessed attachment fixings for securing to the headpiece or the sidepieces or to the headpiece and to the sidepieces, the fixings having a recessed fixing access, wherein a guide hole is provided in a lower face of the overhead overlap element, extending upwardly into the overhead overlap element, for a purpose of extending a key upwardly within the guide hole and of engaging the recessed attachment fixings.

7. The anti ligature pocket slide opening door assembly as claimed in claim 1, wherein the door leaf bottom edge comprises a sliding element for seating in a corresponding slidingly engageable bottom piece to the door frame assembly, and wherein the door leaf comprises a key operated bolt recessed within the door leaf wherein the bolt is advanceable by a key operation to extend vertically out of the door leaf from the door leaf bottom edge and align with an aperture in a track of the slidingly engageable bottom piece adapted to receive the bolt in an advanced position and lock the door leaf in the open position, and to retract back into a recessed position wherein an access aperture extends within the door leaf from a side edge or a face of the door leaf for access via a key having a shank of a suitable length.

8. The anti ligature pocket slide opening door assembly according to claim 1, which lacks ligature points, wherein the pocket is dimensioned to entirely receive the door leaf, such that the door leaf is flush with the pocket or is recessed within the pocket, wherein the door leaf lacks a door handle.

9. The anti ligature pocket slide opening door assembly according to claim 3, wherein the oversized pocket comprises a horizontal steel framework bracing to a vertical steel framework wherein the horizontal steel framework bracing is oversized and is disposed in a height of the oversized pocket and at an overhead and a base of the oversized pocket whereby the oversized pocket is rendered resilient to flex and deformation during a delivery of the oversized door frame assembly rotated onto a side of the oversized door frame assembly with the oversized pocket or sidepiece uppermost.

10. The anti ligature pocket slide opening door assembly according to claim 1, wherein the height D.h of the door leaf is in a range from 230 cm to 290 cm and the overhead overlap height o.h is in the range selected from 5 cm to 40 cm and the oversized overhead overlap is disposed at an elevation above the floor of 222 cm to 285 cm, whereby the oversized overhead overlap is rendered inaccessible to a flexible or deformable ligature, or wherein the height D.h of the door leaf is in the range from 240 cm to 290 cm and the overhead overlap height o.h in the range selected from 5 cm to 40 cm and the oversized overhead overlap is disposed at an elevation above the floor in a range 232 cm to 285 cm, whereby the oversized overhead overlap is rendered inaccessible to a rigid or resiliently deformable ligature.

11. The anti-ligature pocket slide opening door assembly according to claim 1, wherein the at least one overhead overlap element and a face of the headpiece or the sidepieces of the door frame assembly against which the at least one overhead overlap element is to seat comprise one or more elongate grooves or elongate routered channels and one or more projecting flanges provided in a plane including the door leaf loaded in the door frame assembly, for a mutual seating and a fixing of the at least one overhead overlap element to the face of the door frame assembly, thereby providing a reinforcement in the plane, wherein the one or more projecting flanges comprise an elongate L-sections or T-sections or an elongate double inverted section thereof secured to one of the headpiece or the sidepieces of the door frame assembly and the overhead overlap element, to be received in the routered channels or the grooves in the other thereof.

12. The anti ligature pocket slide opening door assembly according to claim 1, wherein the height D.h of the door leaf is in a range selected from 224 cm to 258 cm and 230 cm to 290 cm; and the overhead overlap height o.h in a range from 8 cm to 40 cm, and the overhead overlap is configured to be disposed at an elevation above the floor of greater than or equal to 216 cm.

13. The anti-ligature pocket slide opening door assembly according to claim 1 each of the sidepieces comprise projecting elongate flanges and the at least one overhead overlap element comprises mating slots, the flanges and the slots mateable by a sliding insertion of the at least one overhead overlap element from a first direction, the at least one overhead overlap element and the headpiece or the sidepieces or the headpiece and the sidepieces, comprising recessed attachment fixings to prevent an unauthorized reverse detachment, wherein the flanges and the slots are provided on a face of the sidepieces adjoining a face of the at least one overhead overlap element, and the faces are vertically disposed in use, and sliding insertion is upwardly directed, from within a clear opening of the door frame assembly.

14. The anti ligature pocket slide opening door assembly according to claim 1, wherein D.h is in a range selected from 220 cm to 268 cm and 230 cm to 290 cm.

15. The anti ligature pocket slide opening door assembly according to claim 1, wherein o.h is in a range from 14 cm to 25 cm.

16. The anti ligature pocket slide opening door assembly according to claim 1, wherein ov.h is in a range from 13 cm to 54 cm.

17. The anti ligature pocket slide opening door assembly according to claim 1, wherein:

the overhead overlap $O^O$ provides an overhead overlap tolerance o.t. in the range from 0.1 to 1.0 cm between a face of the overhead overlap element which is configured to be parallel opposed to a face of the door leaf overlapped thereby; and a ratio of o.h to o.t is in a range from 40 to 133.

18. The anti ligature pocket slide opening door assembly according to claim 1, wherein the overhead overlap $O^O$ provides:

an overhead overlap tolerance o.t. in the range from 0.1 to 1.0 cm between a face of the overhead overlap element which is configured to be parallel opposed to a face of the door leaf overlapped thereby; and an overlap angle o.a in the range from 8° to 0.2°, wherein o.a is an angle subtended by a maximum access line a.l., which is a shortest distance between the top edge of the door leaf and a lower edge of the overhead overlap element, wherein o.h, o.t. and a.l form a right angled triangle, whereby the overlap void prevents access to the sliding assembly for a ligature purpose.

19. The anti ligature pocket slide opening door assembly according to claim 2, wherein the corresponding mating component provided internally within the pocket is selected from:

an L plate mounted on a pocket side wall or a pocket rear wall or a pocket side wall and a pocket rear wall, for supporting the mating component at a pocket end of the removable sliding assembly track element which comprises a projecting lip; and a plurality of mushroom heads, projecting upwardly from the removable sliding assembly track element and adapted to be received in a corresponding number of keyhole slots provided in the headpiece, wherein the mushroom heads are configured to be received in the keyholes and retained by advancing the track, and the mushroom heads, to seat in a narrowed portion of the slots.

20. A kit for an anti ligature pocket slide opening door assembly for use in a building which houses an individual at a risk of intentional self-harming, wherein the kit comprises:

a door frame assembly which comprises a headpiece, a bottom piece and two sidepieces and a pocket, a door leaf which comprises a door leaf top edge, a closing side edge, a pocket side edge and a bottom edge, a sliding assembly for slideable translation of the door leaf in relation to the door frame assembly between a closed position and an open position, and at least one overhead overlap element securable by anti ligature fixings wherein the door frame assembly provides, with the door leaf in the closed position:

an overhead overlap ($O^O$) with the door leaf at the top edge overhead overlap element to the door frame assembly, provided separate from the headpiece for securing by an anti tamper and anti ligature fixings, wherein the overhead overlap is characterised by an overhead overlap height o.h being a height of the door leaf overlapped by the at least one overhead overlap element;

a closing side overlap ($O^C$) with the door leaf at the closing side edge; and a pocket side overlap ($O^P$) with the door leaf at the pocket side edge, wherein $O^P$ is in a range from 1.2 cm to 5 cm;

wherein the sliding assembly is an electromagnetic drive sliding assembly having components disposed in relation to the electromagnetic drive sliding assembly, and configured to decelerate the door leaf approaching the closed position or the open position or to absorb impact of the door leaf on the door frame assembly, at a moment of reaching the closed position or the open position;

and wherein:

the pocket and the door leaf are oversized, and the door frame assembly is correspondingly oversized, and the oversized door leaf has a height D.h. in a range from 220 cm up to 300 cm;

the overhead overlap element is oversized, and has an oversized overhead overlap height o.h in a range from 5 cm to 40 cm;

and the sliding assembly is disposed within the headpiece of the oversized door frame assembly at a top portion of, or overhead, the oversized overhead overlap element, which prevents access to the sliding assembly for a ligature purpose, with the oversized door leaf in the closed position;

and the oversized door frame assembly, with the oversized door leaf in the open position or in a partially open position, provides an oversized overhead overlap void which has an overlap void height ov.h in a range from 7 cm to 54 cm being a sum of o.h and a vertical separation between the top edge of the oversized door leaf and the sliding assembly, whereby with the oversized door leaf in the open position or in the partially open position, the oversized overlap void prevents access to the sliding assembly for a ligature purpose.

* * * * *